US012601496B2

(12) United States Patent
Hale et al.

(10) Patent No.: US 12,601,496 B2
(45) Date of Patent: Apr. 14, 2026

(54) ASSEMBLABLE FIRE PIT INSERT

(71) Applicant: Quality Craft Industries, Inc., Romeoville, IL (US)

(72) Inventors: Dennis Hale, Willowbrook, IL (US); Marcus W. Bosch, Belding, MI (US); Shelley Nehrt, Barrington, IL (US); Rolando Hernandez, Oak Lawn, IL (US)

(73) Assignee: Quality Craft Industries, Inc., Romeoville, IL (US)

( * ) Notice: Subject to any disclaimer, the term of this patent is extended or adjusted under 35 U.S.C. 154(b) by 0 days.

(21) Appl. No.: 18/435,862

(22) Filed: Feb. 7, 2024

(65) Prior Publication Data

US 2024/0280267 A1 Aug. 22, 2024

Related U.S. Application Data

(63) Continuation of application No. 17/541,087, filed on Dec. 2, 2021, now Pat. No. 12,345,419.
(Continued)

(51) Int. Cl.
*F24B 1/195* (2006.01)
*F24B 1/181* (2006.01)
(Continued)

(52) U.S. Cl.
CPC ..... *F24B 1/195* (2013.01); *F24B 1/181* (2013.01); *F24B 1/182* (2013.01); *F24B 1/1915* (2013.01)

(58) Field of Classification Search
CPC ..... A47J 37/0763
See application file for complete search history.

(56) References Cited

U.S. PATENT DOCUMENTS 2,161,669 A 6/1939 Freeman
4,457,290 A 7/1984 Edwards
(Continued)

FOREIGN PATENT DOCUMENTS

CN 108826360 A 11/2018
GB 2340930 A 3/2000
(Continued)

OTHER PUBLICATIONS

Notice of Allowance received for U.S. Appl. No. 17/541,087, mailed on Mar. 18, 2025, 5 pages.
(Continued)

*Primary Examiner* — Jason Lau
(74) *Attorney, Agent, or Firm* — Shook, Hardy & Bacon L.L.P.

(57) ABSTRACT

A fire pit insert that is constructed to be shipped and sold in a disassembled state and then assembled by the end user is shown and described. The fire pit insert includes a plurality of wall panels that are removably coupled together to define a burn pit. A plurality of rim portions are attachable to the plurality of wall panels. The plurality of wall panels include an interior wall segment spaced apart from an exterior wall segment to define an interior in the plurality of wall panels that permit airflow there through during operation. The exterior wall segments have a first leg, a second leg, and a recessed portion located between the first and second legs to permit the fire pit insert to be self-supporting when assembled. The fire pit insert can be inserted into a surrounding enclosure.

19 Claims, 24 Drawing Sheets

Related U.S. Application Data

(60) Provisional application No. 63/210,477, filed on Jun. 14, 2021, provisional application No. 63/121,772, filed on Dec. 4, 2020.

(51) Int. Cl.
*F24B 1/182* (2006.01)
*F24B 1/191* (2006.01)

(56) References Cited

U.S. PATENT DOCUMENTS

| | | | | |
|---|---|---|---|---|
| 4,869,228 | A | 9/1989 | Sorensen | |
| 2006/0225725 | A1 | 10/2006 | Rinaldo | |
| 2008/0053427 | A1 | 3/2008 | Mcginness | |
| 2010/0288261 | A1* | 11/2010 | Jones | F24C 1/02 126/25 R |
| 2012/0255542 | A1 | 10/2012 | Kukuliyev | |
| 2014/0238378 | A1 | 8/2014 | Scott | |
| 2020/0224879 | A1 | 7/2020 | Scott | |
| 2020/0309369 | A1 | 10/2020 | Jan et al. | |
| 2021/0285648 | A1 | 9/2021 | Kim et al. | |

FOREIGN PATENT DOCUMENTS

| | | | |
|---|---|---|---|
| KR | 10-1186499 | B1 | 9/2012 |
| KR | 10-2020-0077403 | A | 6/2020 |
| KR | 10-2020-0078427 | A | 7/2020 |

OTHER PUBLICATIONS

International Preliminary Report on Patentability received for PCT Patent Application No. PCT/US2021/061882, mailed on Jun. 15, 2023, 11 pages.
International Search Report and Written Opinion received for PCT Patent Application No. PCT/US2021/061882, mailed on Feb. 25, 2022, 12 pages.
Non-Final Office Action received for U.S. Appl. No. 17/541,087, mailed on Apr. 10, 2024, 21 pages.
Final Office Action received for U.S. Appl. No. 17/541,087, mailed on Nov. 27, 2024, 14 pages.
Non-Final Office Action received for U.S. Appl. No. 18/107,483, mailed on Apr. 28, 2025, 12 pages.
Office Action received for Canadian Patent Application No. 3231965, mailed on Dec. 30, 2025, 5 pages.

* cited by examiner

ASSEMBLABLE FIRE PIT INSERT

CROSS-REFERENCE TO RELATED APPLICATIONS

This Continuation in Part claims the benefit of Non-Provisional patent application Ser. No. 17/541,087, filed on Dec. 2, 2021, and entitled "Assemblable Fire Pit" which claims the benefit of U.S. Provisional Patent Application No. 63/121,772, filed Dec. 4, 2020, and entitled "Assemblable Smoke-Free Fire Pit", and U.S. Provisional Patent Application No. 63/210,477, filed Jun. 14, 2021, and entitled "Assemblable Smoke-Free Fire Pit", the entire contents of which are incorporated herein by reference.

BACKGROUND

In recent years, "smoke free" or "smokeless" fire pits have become popular. Common fire pits of this type have a double wall construction with holes near the top and bottom of the interior wall. This allows air to be drawn up between the walls via convection and discharged in the interior of the burn chamber. Outside air is pulled into the bottom holes and moves through the hollow wall up to the inside holes. As the air moves up, it is heated. The heated air is released through the inner holes into the top of the burn chamber, infusing the fire with an extra boost of oxygen, which improves the burn.

However, there are some drawbacks with the existing fire pits. First, they are sold to consumers as a complete unit due at least in part to the dual-wall construction. The available units are typically round and generally constructed from flat sheets of metal bent in certain shapes and then welded together to form the dual wall fire pit. This requires the units to be sold as a fully assembled fire pit. As a result, when each unit is boxed for transportation and sale, the box contains a large amount of empty space, generally in the burn chamber area. What is needed is a design of a fire pit that can be assembled by an end user from various panels or parts that can be stacked flat for packaging and shipping to reduce the amount of space required in the container when compared to current versions, yet still offer the benefits of a double wall construction.

Additionally, a fire pit insert that can be assembled similarly and inserted into a surrounding structure or free standing and self-supporting provides additional options for the use of a fire pit insert. Previously, consumers have been limited to the completely assembled fire pits on the market and unable to customize the designs or look of the pit without full customization, which is costly and often unaffordable. As such, a fire pit insert that can be assembled and allows the end user to build a surrounding enclosure such as a brick layered surround without requiring customization of each piece of the fire pit is advantageous and provides additional options to the consumer without significantly increasing the costs. Additionally, an insert that can be inserted into a surrounding structure or that is free standing and self-supporting also provides for the ability to transfer the fire pit. As such, there is a need for an assemblable fire pit insert that can be assembled by an end user and can either stand alone or be inserted into some sort of surrounding structure, allowing for the "DIY" customization of the a fire pit, while decreasing the amount of space needed for shipping and lowering the cost involved with customizing a fire pit insert.

SUMMARY

Embodiments of the present disclosure relate to a fire pit configured to be sold in a disassembled state and be assembled by the end user or other person. In the disassembled state, the various components (as discussed herein) are in a relatively flat configuration. In the disassembled state, the components contain relatively less void space between the components, in comparison to the assembled state. In the disassembled state, the components may be packaged into a relatively small container, compared to the size of a container that would be required to hold a fire pit that is similar in size to the present fire pit when fully assembled. Embodiments of the invention thus allow for the packaging of a fire pit using less packaging than traditional fire pits and/or allow for an ultimately larger operational fire pit to be packaged in a similar amount of packaging.

A first example embodiment of the invention is directed to a fire pit. The fire pit includes a plurality of wall panels, an ash catch, and a grate. The plurality of wall panels are configured to define a burn chamber when connected together. Each of the plurality of wall panels has an interior wall segment spaced apart from an exterior wall segment. The ash catch is removably positionable and configured to be disposed within the burn chamber. The grate is positionable above the ash catch. A first wall panel of the plurality of wall panels is configured to be secured to a second wall panel of the plurality of wall panels.

A second example embodiment of the invention is directed to a fire pit system configured to be assembled by an end user. The system includes a plurality of wall panels, an ash catch, and a grate. The plurality of wall panels are configured to be secured together by the end user to form a burn chamber. Each of the plurality of wall panels has an interior wall segment spaced apart from an exterior wall segment. Each interior wall segment includes at least one opening in an upper end to allow airflow into the burn chamber. The ash catch is removably positionable and configured to be disposed within the burn chamber by the end user. The grate is positionable above the ash catch by the end user.

A third example embodiment of the invention is directed to a method of assembling a fire pit. The method may include securing a plurality of wall panels together to form a burn chamber, with each of the plurality of wall panels having an interior wall segment spaced apart from an exterior wall segment. The method may further include positioning an ash catch on a flange of one or more of the interior wall segments within the burn chamber. The method may further include removably positioning a grate above the ash catch.

Other embodiments of the invention may be directed to a fire pit comprising the plurality of wall panels. Still other embodiments of the invention may be directed to manufacturing a fire pit as described herein. Yet still other embodiments of the invention may be directed to using the fire pit described herein to burn a fuel. These and other embodiments may be within the scope of the invention.

In a fourth example embodiment of the invention disclosed herein, a fire pit insert system configured to be assembled by an end user and inserted into a surrounding structure is disclosed. The fire pit insert comprises a plurality of wall panels comprising a top end and a bottom end and configured to be coupled together to form a burn chamber. In embodiments, each of the plurality of wall panels has a non-linear shape and an interior wall segment spaced apart from an exterior wall segment. At least one of the interior wall segments includes an opening at a top end and each of the plurality of wall panels are configured to be removably coupled with an adjacent panel to form the insert. The fire pit insert further includes a plurality of rim portions, wherein each of the rim portions has a top surface and a bottom surface, wherein a first rim portion is coupled to a first of the plurality of wall panels.

In a fifth example embodiment of the invention disclosed herein, a fire pit insert system that is configured to be assembled by an end user is disclosed. In this embodiment, a plurality of rim portions are configured to rest on a top surface of a structure surrounding a fire pit insert and a plurality of wall panels configured to be secured together by the end user to form a burn chamber. Each of the plurality of wall panels has an interior wall segment spaced apart from an exterior wall segment and a first wall panel of the plurality of wall panels is removably coupled to a first rim portion of the plurality of rim portions.

In yet another embodiment, a method of assembling a fire pit insert is disclosed. The method includes securing a plurality of wall panels together to form a burn chamber, wherein each of the plurality of wall panels has an interior wall segment spaced apart from an exterior wall segment and wherein each of the plurality of wall panels comprise a top portion and a bottom portion, the bottom portion comprising one or more legs that extend further vertically than a middle recessed portion. An ash catch is removably positioned on a flange of the interior wall segment within the burn chamber and a grate is positioned above the ash catch. The plurality of rim portions are secured to a top portion of the plurality of wall panels. A first wall panel of the plurality of wall panels is configured to be connected together by aligning a hole in one flange with a hole on the opposite edge of an adjacent panel.

BRIEF DESCRIPTION OF THE DRAWINGS

The present systems and methods for fire pits are described in detail below with reference to the attached drawing figures, wherein.

DETAILED DESCRIPTION

Systems and methods are disclosed related to fire pits and fire pit inserts. Although primarily described herein with respect to fire pits, this is not intended to be limiting, and the systems and methods of the present disclosure may be implemented in any implementation. For non-limiting examples, the systems and methods described herein may be implemented for various types of fire pits, fire places, grills, smokers, kilns, forges, and other devices and systems that contain a fire. In other non-limiting examples, the systems and methods described herein may be implemented for various types of fuel/heat sources, such as wood (including logs, chunks, chips, etc.), charcoal, pellets, propane, butane, electric, or the like.

Figure 6:
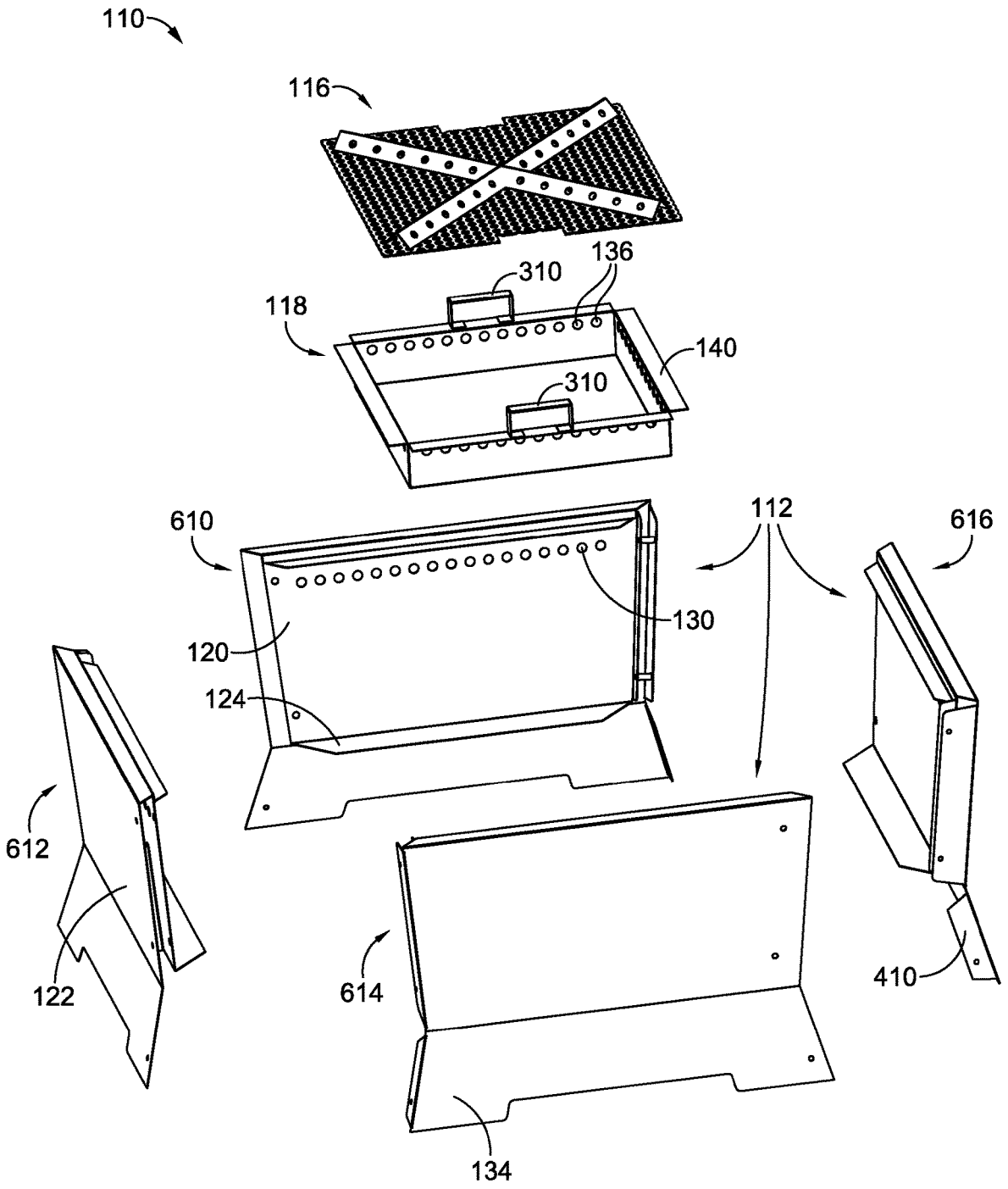
FIG. 6 is an exploded view of the fire pit of FIG. 1.

Referring now to the accompanying drawings, a fully assembled fire pit 110 made in accordance with the present disclosure is shown. A fully assembled version of the fire pit 110 of the present disclosure is displayed in two perspective views in FIGS. 1 and 2. Embodiments of the invention are configured to be sold in a disassembled state, such as shown in FIG. 6, and be assembled by the end user or another person. In the disassembled state, the various components (as discussed herein) are in a relatively flat configuration. In the disassembled state, the components contain relatively less void space between the components, in comparison to in the assembled state. In the disassembled state, the components may be packed into a relatively small packaging, compared to an amount of packaging that would be required to package the fire pit 110 in its fully assembled state. Embodiments of the invention thus allow the packaging of a fire pit 110 using less packaging than that of traditional fire pits 110 and/or allow for a larger fire pit 110 to be packaged in a similar amount of packaging. This not only reduces international and domestic shipping costs, but also reduces the amount of display space needed in a store.

In embodiments of the invention, an end user may acquire a packaged fire pit 110 in a disassembled state. The end user may then assemble the fire pit 110 upon removing the components from the packaging. The assembled fire pit 110 may be substantially larger than the packaging. The components may be assembled via various methods as described herein. The assembled fire pit 110 may thus be assembled and disassembled as needed by the end user.

The fire pit 110 is assembled from a plurality of wall panels 112 (such as four, as shown in the drawings). The wall panels 112, once assembled, define a burn chamber 114 there between. Any of various fuels and/or heat sources may be placed within the burn chamber 114 on top of a grate 116 to be burned. The grate 116 sits on top of a removable fire pan or ash catch 118. Ash and other debris from the burning fuel may then fall through the grate 116 and into the ash catch 118 during operation. The ash may then remain in the ash catch 118 until the ash catch 118 is removed by an end user for disposal. The ash catch 118 also allows for the ash to be selectively removed from the burn chamber 114 so as to not hamper the burning process. This allows for a more clean burn in the burn chamber 114. While the illustrated embodiment and the description below describe one possible embodiment of an ash catch, the term "ash catch", as used herein, should not be narrowly construed to cover the illustrated embodiment but should be broadly defined as an item of any size, shape, and construction that performs the function of collecting or holding ashes that result from the burning of fuel or heat sources there above and can be removable from, separate from, or affixed to the fire pit.

Figure 1:
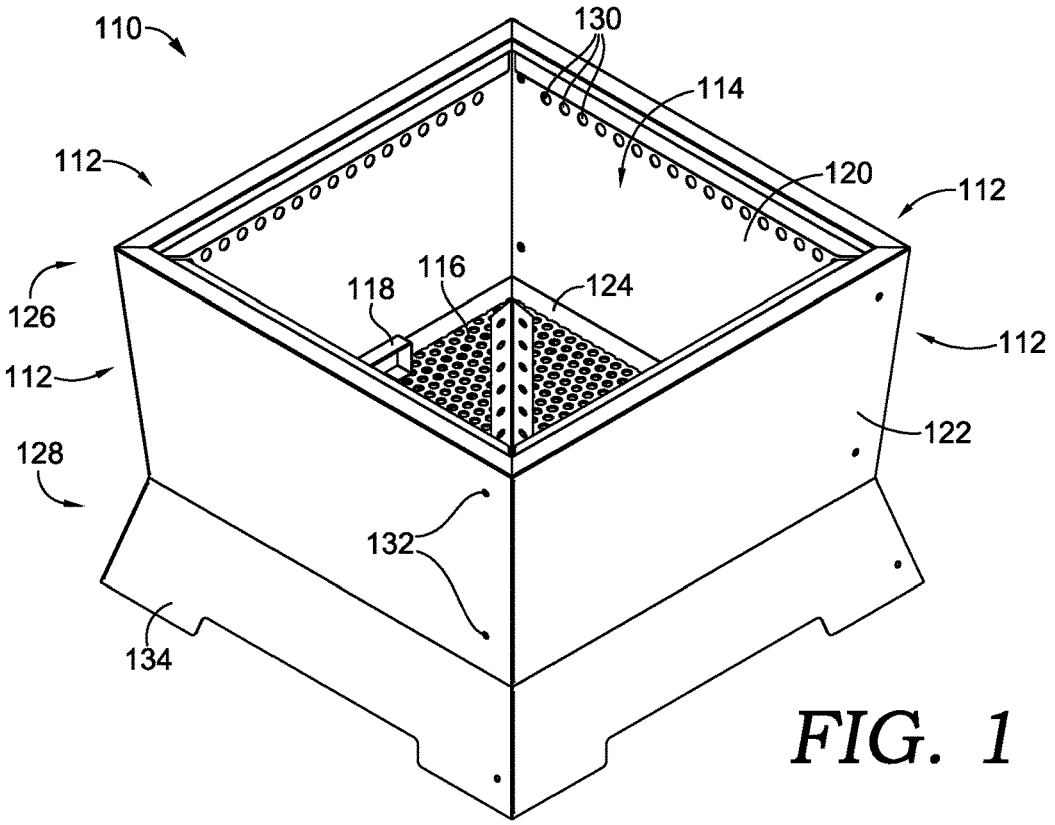
FIG. 1 is a top perspective view of a fire pit from a first angle, in accordance with some embodiments of the present disclosure.
Figure 2:
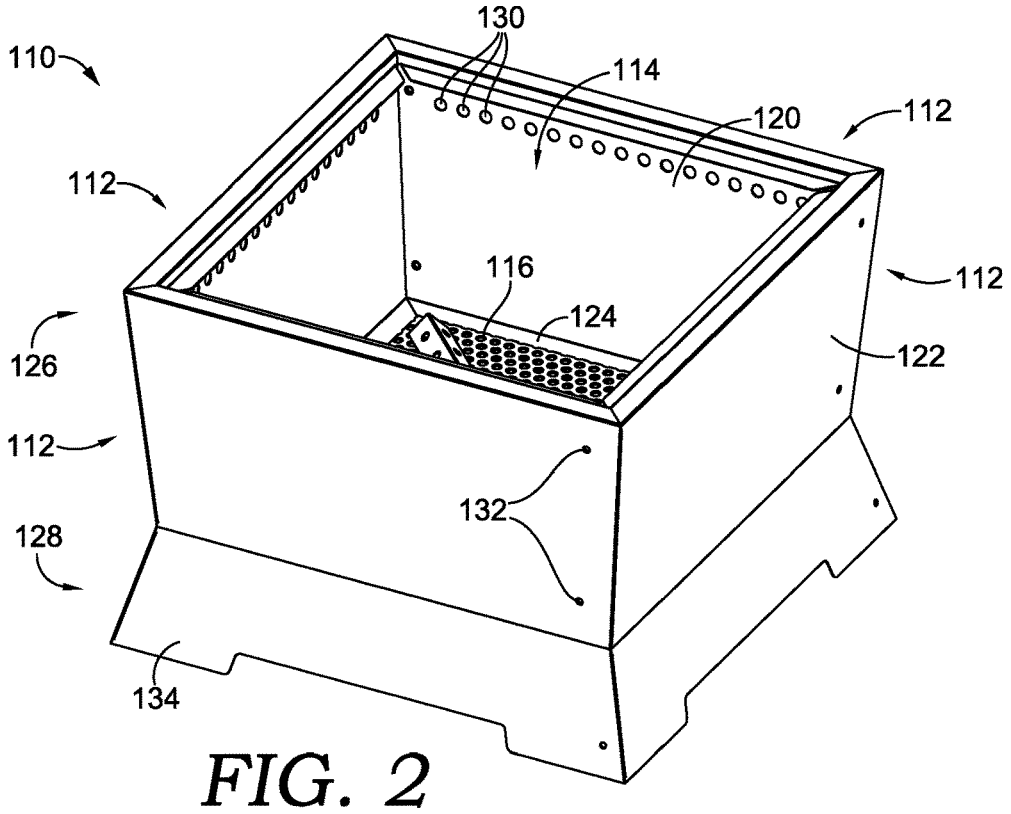
FIG. 2 is a top perspective view of the fire pit of FIG. 1 from a second angle.
Figure 20:
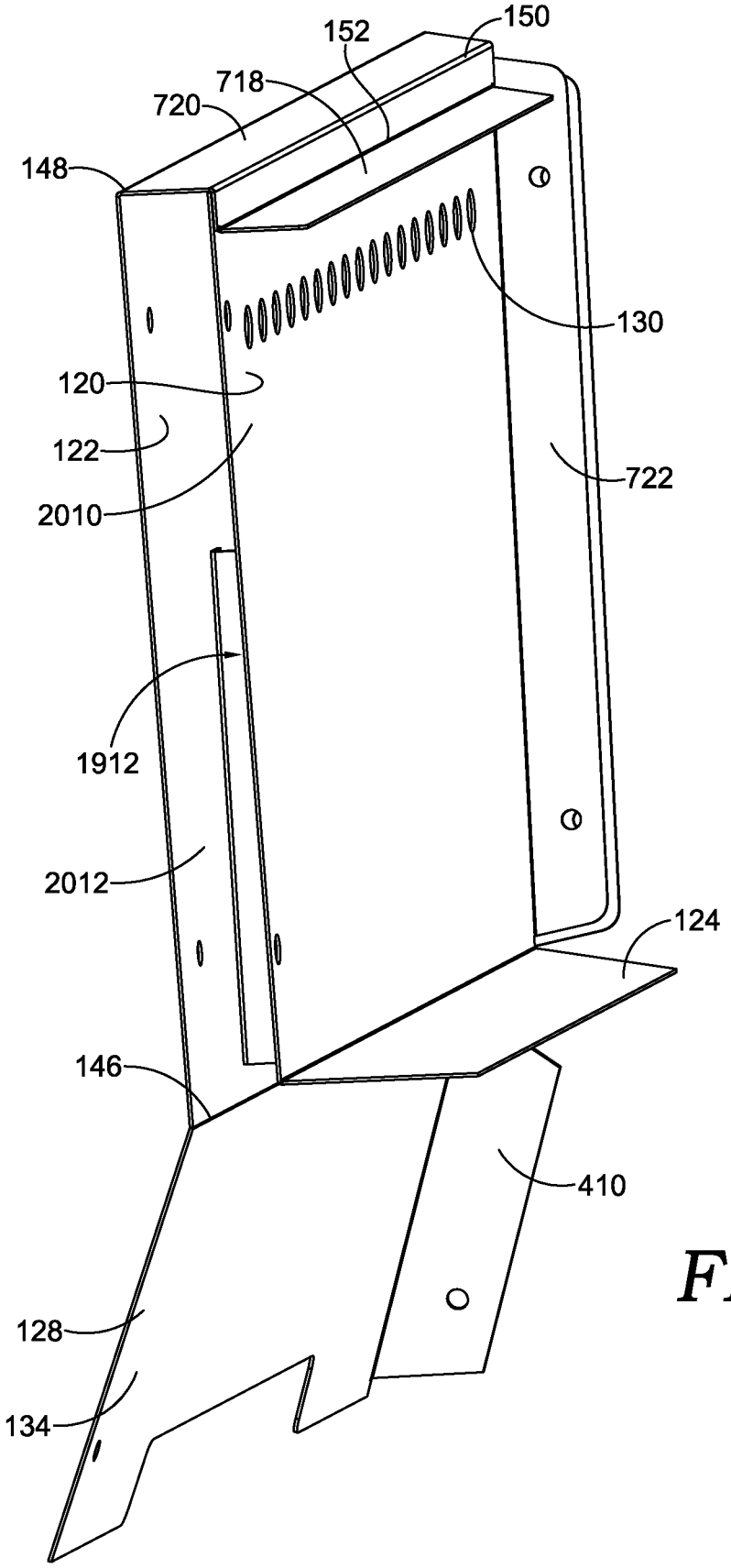
FIG. 20 is a top left perspective view of the side wall of FIG. 7 from a sixth angle illustrating interior components thereof.

In embodiments, each wall panel 112 includes an interior wall segment 120 and an exterior wall segment 122, as illustrated in FIGS. 1, 2, and 20. The interior wall segment 120 of the wall panel 112 may include a lower support or flange 124 extending into the burn chamber 114 to support at least one of the grate 116 and the ash catch 118. As used herein, the term "flange" is used broadly as a generic reference to a piece of material that extends from a portion of another piece of material and does not require the provision of additional strength or stiffness. Further, it does not imply any particular dimensions. It can be elongate in a lateral direction, short in a lateral direction (e.g., like a tab), or anywhere in between. The wall panel 112 has an upper end 126 and a lower end 128. The upper end 126 may include one or more airflow openings 130 into the burn chamber. Primarily due to convection, air is drawn up into the wall panel 112 at the lower end 128, which is open toward the ground. The air, as it is heated, rises up through and interior of the wall panel 112 between the inner wall 120 and the outer wall 122, and out into the burn chamber 114 through the airflow openings 130 at the upper end 126. Securing openings 132 may be configured to allow for securing of one wall panel 112 to an adjacent wall panel 112, as discussed herein. The lower end 128 may also include a base 134 configured to rest upon an underlying surface and provide stability while keeping the burn chamber 114 away from the underlying surface.

The wall panels 112 may include interlocking flanges on one side with holes therein that align with holes in an adjacent panel (see FIGS. 10-13). The holes in the flanges can be spaced apart by a tube positioned between the flanges and coaxial with the aligned holes in the adjacent flanges so the holes and the tube form a passageway for the user to place a bolt in during assembly. The tubes direct the bolt from one hole to the next so the distal end of the bolt does not get "lost" inside the wall panel 112 during assembly. The user aligns both sets of holes and places a bolt there through to couple adjacent panels. The metal sheet material can be laser cut while flat before the bending occurs. The holes for the bolts and the airflow openings 130 for the air flow can be cut out at the same time. The metal sheet material may be bent back upon itself to form the dual wall construction. A first portion of the exterior wall segment 122 of the wall panel 112 may be bent outwardly to form the base 134 when fully assembled. A first portion of the interior wall segment 120 may be bent inwardly to form the ledge 124 upon which the fire pan or ash catch 118 may be supported in use.

In some embodiments, the wall panels 112 may be identical, for ease of manufacture and assembly. In other embodiments, the wall panels 112 can vary from one to another for a particular design. The wall panels 112 may be formed from metal sheet material bent to provide a dual-wall structure.

With reference to FIG. 1, the two rearward wall panels 112 illustrate the interior wall segments 120 with the plurality of airflow openings 130 at the upper end 126 thereof to assist with the double burn found in smoke-free or reduced-smoke fire pits with a double wall construction. The two forward wall panels 112 illustrate a first portion of the exterior wall segments 122 of the wall panels 112 that are bent outwardly to form the base 134 at the lower end 128 thereof.

Figure 3:
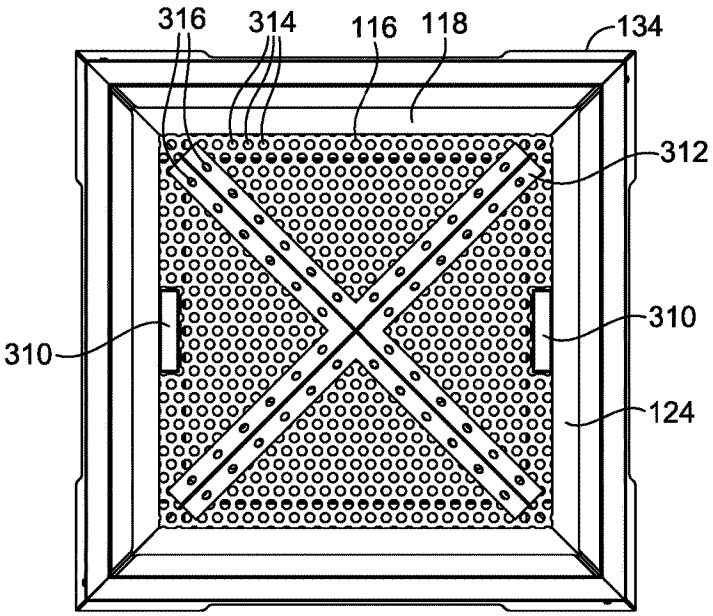
FIG. 3 is a top plan view of the fire pit of FIG. 1.

The grate 116 will now be discussed in more detail. FIG. 3 is a top plan view of the fire pit 110 of FIG. 1, which more clearly illustrates the grate 116. The grate 116 is configured to sit atop the ash catch 118 such that at least one handle 310 of the ash catch is accessible through or beside the grate 116. The grate 116 may have a cross member 312 for structural stability. The grate 116 may be a metal plate with a plurality of openings 314 there through to provide for the passage of air during the burning of the material placed inside the burn chamber 114, as well as the passage of ash into the ash catch 118. The grate 116 may be reinforced with the cross member 312 which, in the illustrated embodiment is in the shape of an angle iron. The arms of the cross member may have holes 316 there through to further facilitate the passage of air from below the grate 116 up through the grate 116 and into the burn chamber 114 during use. Also visible in FIG. 3 are two handles 310 that may be used to lift the fire pan or ash catch 118 directly up out of the top of the burn chamber 114 to dump or dispose of the ashes contained therein. The grate 116 sits between and partially around the two handles 310 such that the handles 310 protrude up through the grate 116 to be accessed by a user.

Figure 4:
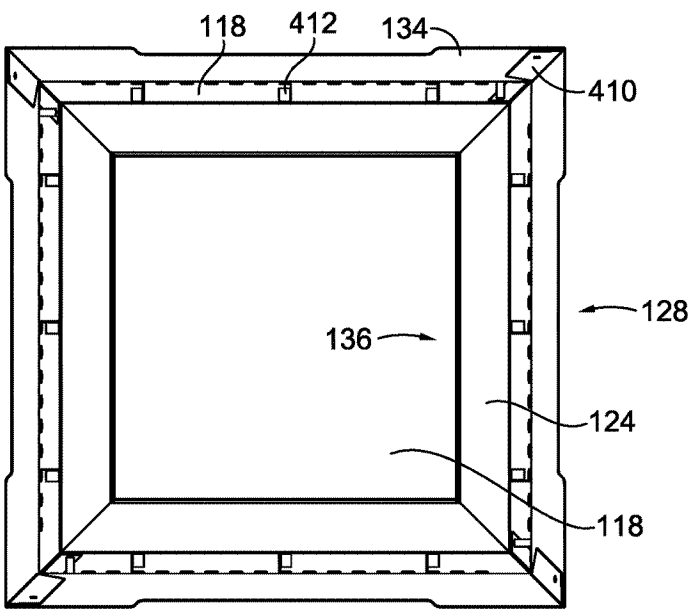
FIG. 4 is a bottom plan view of the fire pit of FIG. 1.

FIG. 4 is a bottom plan view of the fire pit 110 of FIG. 3 illustrating a bottom of the ash catch 118, which is obstructing the view of the grate 116 there above. FIG. 4 shows a securing overlap or tab 410 extending from one wall panel 112 to another. As used herein, the term "tab" is used broadly a generic reference to a piece of material extending from another piece of material. A fastener is secured between the securing tab so as to secure the one wall panel 112 to the other. A lower ledge that is formed by the flange 124 on each of the interior wall segments 120 of each wall panel 112 is shown. Visible in the space between the inner wall 120 and exterior wall 122 are a plurality of gussets 1912 (also visible in FIGS. 19-20) that provide structural support to the wall panel 112. The ledge 124 may support the weight of the ash catch 118, the grate 116, and the fuel. The ledge 124 that is created is used to support a flange 140 that extends around the periphery of the ash catch 118 to support the same thereon during use. When all the wall panels 112 are coupled together, the ledges 124 cooperate to define an inner passageway 136 through which a lower portion of the ash catch passes.

Figure 5:
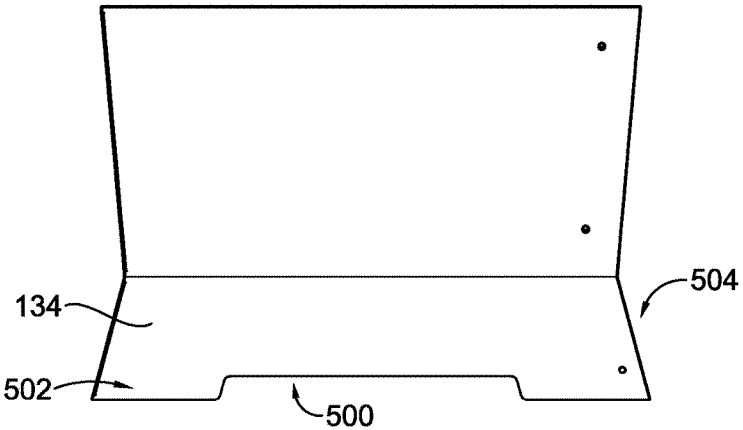
FIG. 5 is a right side elevation view of the fire pit of FIG. 1.

FIG. 5 is a right side elevation view of the fire pit 110 of FIG. 1. In the illustrated embodiment, all four wall panels 112 are of identical construction for ease of manufacture and assembly. As such, each of the side views would be identical for this version. Other embodiments may exist and are within the scope of the present disclosure. For example, two opposite wall panels 112 may be wider than two other wall panels 112 to create a rectangular dual wall assemblable fire pit 110 of the present disclosure. Various combinations and sizes of wall panels 112 may be used to create assemblable fire pits 110 of various sizes, shapes, and dimensions.

Also shown in FIG. 5 is the base 134. In some embodiments, the base 134 includes a cutout or recess 500 which defines two legs 502. The recess 500 allows for unevenness in the underlying surface to not affect the stability of the base 134. The two legs include a flared segment 504 that extends laterally. The flared segment 504 increases the lateral stability of the base 134.

FIG. 6 illustrates an exploded view of the fire pit 110 of FIG. 1. The topmost component is the grate 116 with the structural cross arms depicted thereon. Immediately below that, is the removable ash catch 118. The ash catch 118, much like the inner walls 120, includes a plurality of airflow openings 138 around the upper portion thereof that allow air to come up from underneath the fire pit 110 during use and through the ash catch 118 to helped fuel the combustion of the material placed in the burn chamber 114. A flange (or flanges) 140 extends horizontally outward from each of the sidewalls of the ash catch 118 and is designed to rest on the ledge 124 created by the lower end 128 of the inner sidewalls 120. Below the ash catch 118 are each of the four identical (in the illustrated embodiment) wall panels 112.

While illustrated in FIG. 6 as four identical wall panels 112 in other embodiments they could be four (or more or less) distinct wall panels. Specifically, embodiments of the invention may include a first wall panel 610, a second wall panel 612, a third wall panel 614, and a fourth wall panel 616. As discussed herein, in embodiments, the first wall panel 610 is identical to the second wall panel 612, the third wall panel 614, and the fourth wall panel 616. In other embodiments, the first wall panel 610 may be identical to the third wall panel 614, while the second wall panel 612 is identical to the fourth wall panel 616 (with the first and third wall panels 112 610, 614 having a different length than the second and fourth wall panels 112 616).

Figure 7:
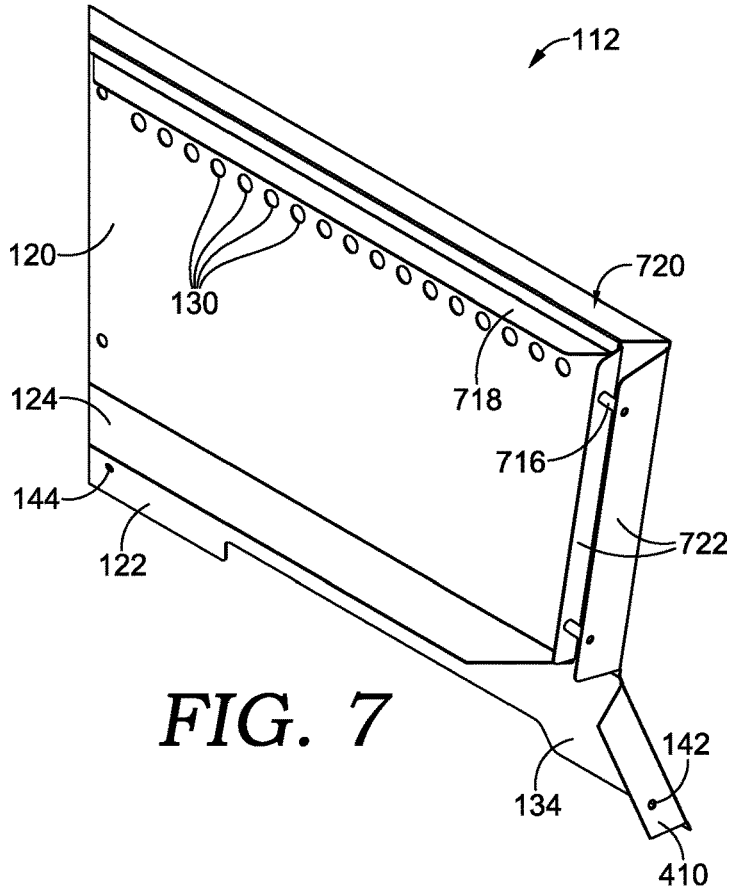
FIG. 7 is a top right perspective view of one of the side walls of the fire pit of FIG. 1 from a third angle.
Figure 8:
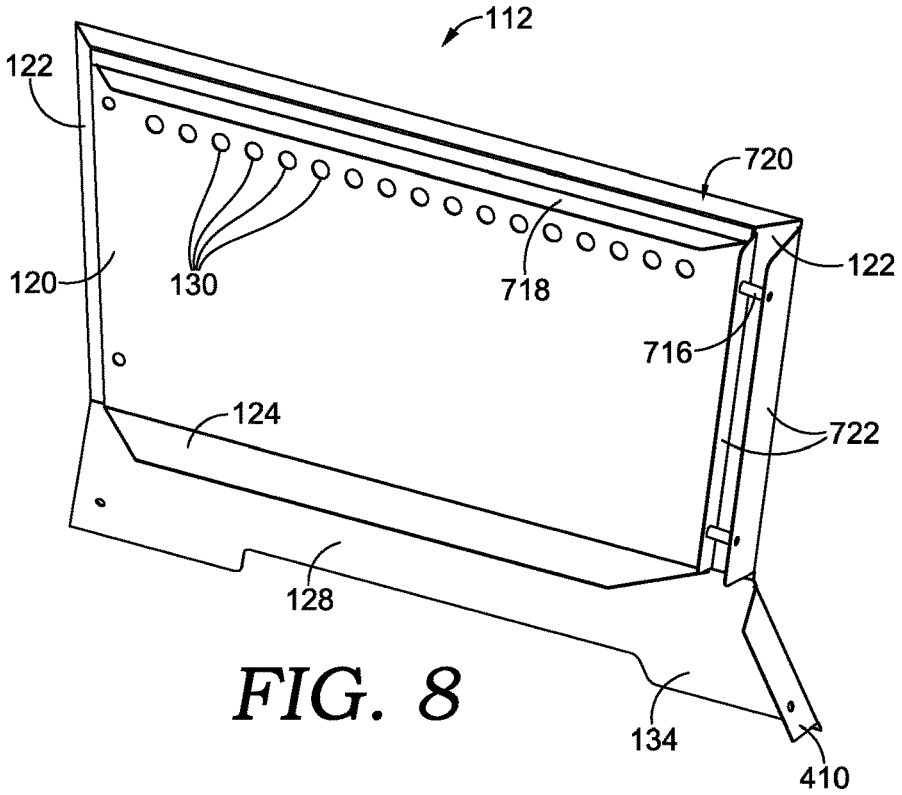
FIG. 8 is a top right perspective view of the side wall of FIG. 7 from a fourth angle.
Figure 22:
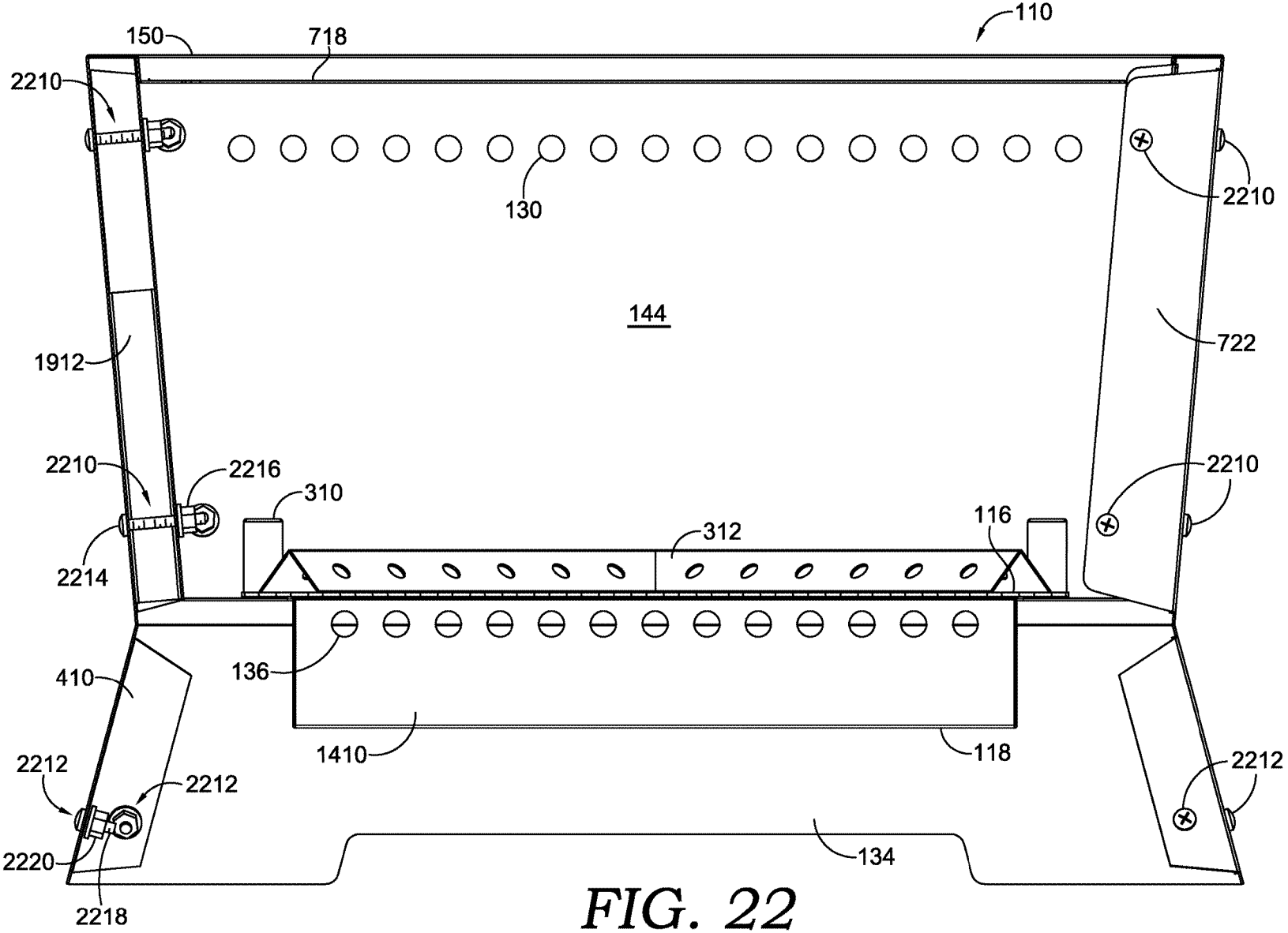
FIG. 22 is a front perspective view of the fire pit of FIG. 1 with the front side wall removed, in accordance with some embodiments of the present disclosure.
Figure 24:
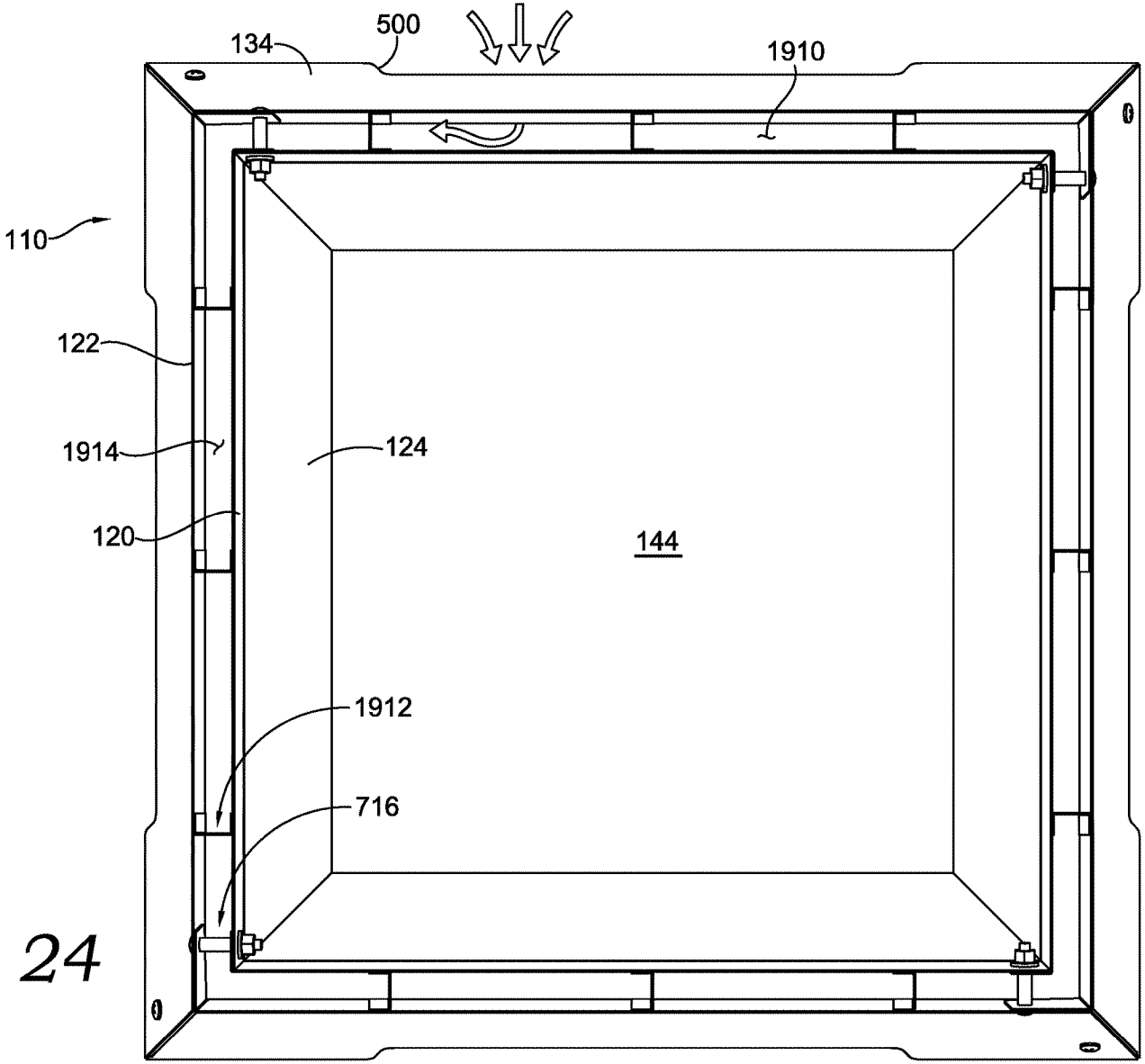
FIG. 24 is a top plan view of a horizontal cross-section of the fire pit of FIG. 1, showing how air flows through the wall panels.

FIGS. 7 and 8 both illustrate perspective views of the wall panel 112 from an upper location looking down towards the inner wall 120 of the wall panel 112 opposite the outer wall 122. The flange 124 extends inward from the inner wall 120. Other flanges may include an upper flange 718, an outer flange 720, and a pair of vertical assembly flanges 722. On the right-hand side of both wall panels 112, spacer tubes 716 are provided between the vertical assembly flanges 722 and separate the inner vertical assembly flange 722 of the inner wall 120 from the outer vertical assembly flange 722 of the outer wall 122. The vertical assembly flanges 722 extends at an approximate right angle inwardly from both the outer wall 122 and the inner wall 120. The assembly flanges 722 are designed to be received in the space between the inner and outer wall 120, 122 of an adjacent wall panel during assembly. In the illustrated embodiment, the spacer tubes 716 have been positioned between the inner and outer wall assembly flanges to assist with the assembly process. The tubes 716 connect upper holes of the flanges and connect the lower holes of the flanges. This arrangement helps guide a bolt through the double-walled wall panel 112 during assembly so that the bolt does not get out of alignment inside the double wall construction. The bolt is shown in FIGS. 22 and 24. The tubes 716 may be omitted and assembly still performed in the same manner.

Also visible in FIGS. 7 and 8 is the securing tab or flange 410 which extends inwardly from the lower end 128 of the exterior wall segment 122 that forms the base 134. The securing tab 410 is also used to assemble or couple one wall panel 112 to an adjacent wall panel 112. The securing tab 410 has a hole 142 there through for assembly and, on an opposite edge of the lower end 128 of the base of the exterior wall segment 122, a corresponding hole 144 is provided. The hole 142 of one panel 112 is aligned with the hole 144 of an adjacent panel 112 during assembly. As can be seen, a portion of the lower end 128 along the bottom edge of the exterior wall segment 122 is cut out define feet portions of the base 134 of the wall panel 112, as well as to permit and assist with the flow of air from outside the fire pit 110 up underneath the fire pit 110 during use.

Figure 9:
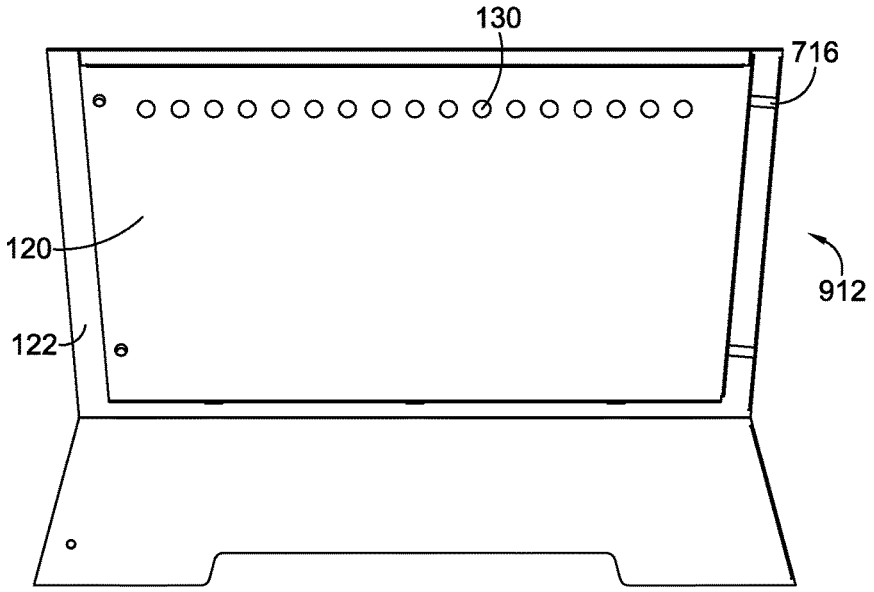
FIG. 9 is a front elevation view of an interior of the side wall of FIG. 7.
Figure 12:
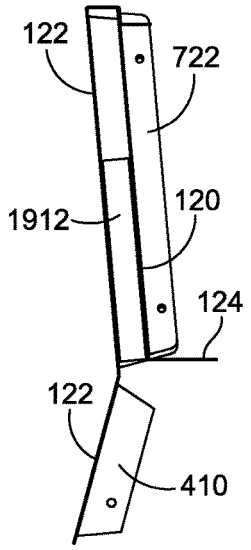
FIG. 12 is a left side elevation view of the side wall of FIG. 7.
Figure 10:
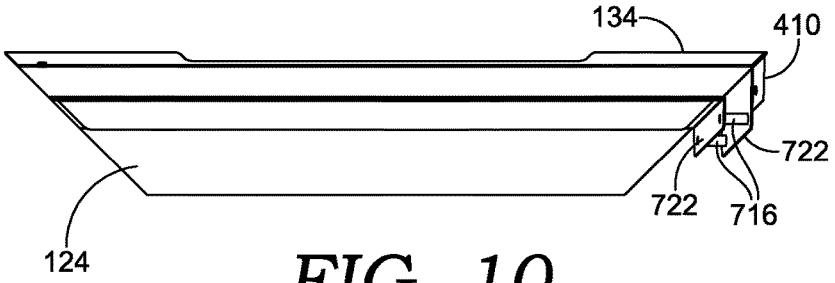
FIG. 10 is a top plan view of the side wall of FIG. 7.
Figure 13:
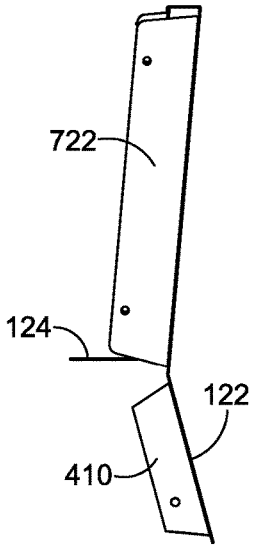
FIG. 13 is a right side elevation of the side wall of FIG. 7.
Figure 11:
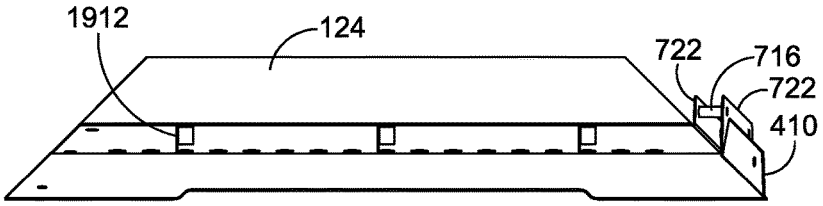
FIG. 11 is a bottom plan view of the side wall of FIG. 7.
Figure 19:
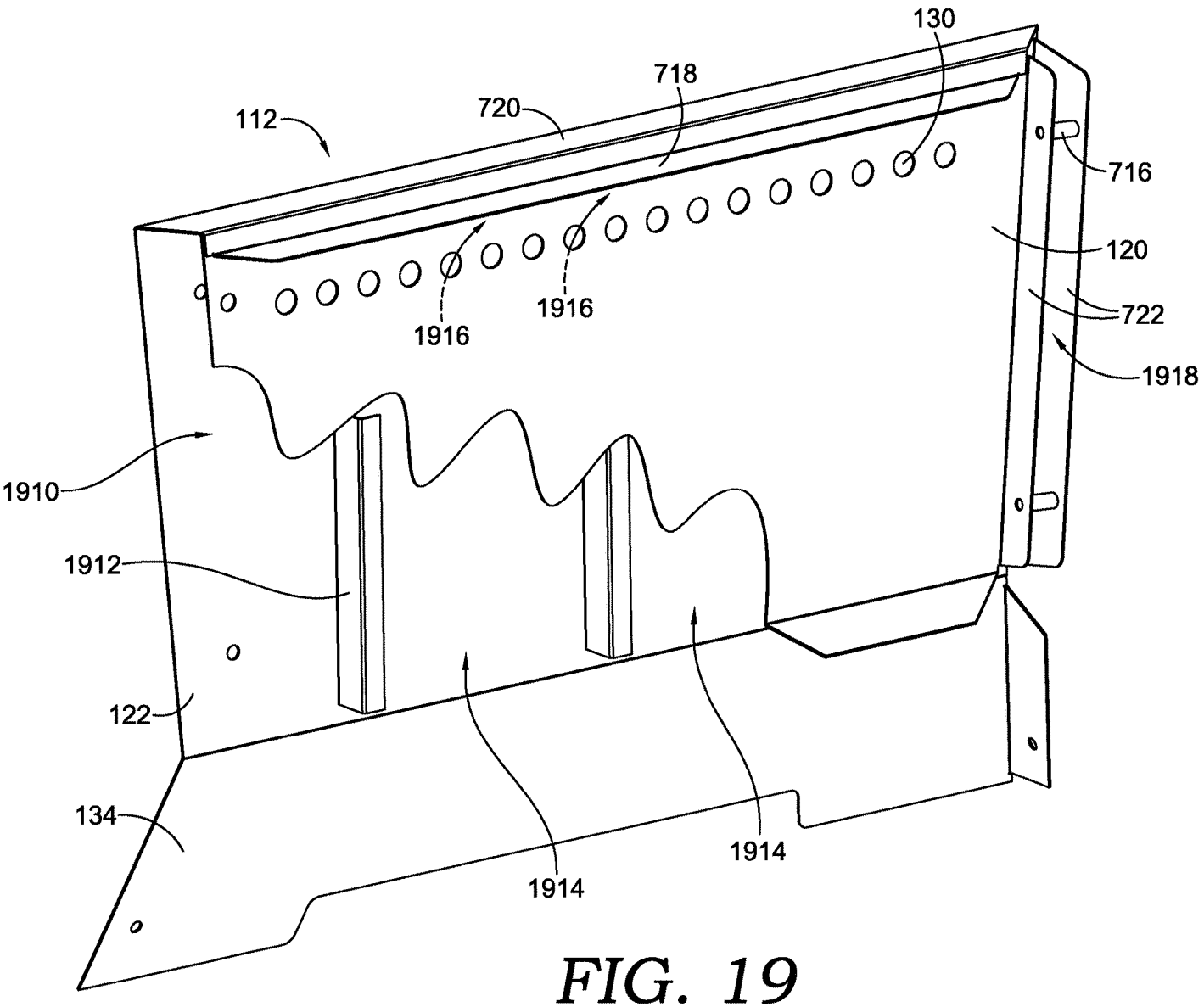
FIG. 19 is a top left perspective view of the side wall of FIG. 7 from a fifth angle with a portion of an interior wall cutaway to illustrate gussets found in the side wall in the illustrated embodiment.

FIG. 9 is a side elevation view of one of the wall panels 112 from an interior vantage point. FIG. 10 is a top plan view of the wall panel 112 of FIG. 9 and FIG. 11 is a bottom plan view of the wall panel 112 of FIG. 9. FIG. 12 is a left side elevation view of the wall panel 112 of FIG. 9 and FIG. 13 is a right side elevation view of the wall panel 112 of FIG. 9. Visible in FIGS. 11 and 12, and more clearly shown in FIG. 19, are gussets 1912 that are positioned between the interior wall panel 120 and the exterior wall panel 122 of the wall panel 112 to provide increase structural integrity so that the wall panels 112 do not flex toward and away from each other during use. The gussets 1912 also provide increased strength for the wall panels 112. When positioned in the vertical orientation, as best illustrated in FIG. 19, the gussets 1912 permit air to still flow up through the space between the interior wall 120 and exterior wall 122 of the wall panel 112 and out the upper portion of the interior wall 120 through the plurality of airflow openings 130, such that heated air flows back into the burn chamber 114, further fueling the combustion of the material therein.

FIG. 10 shows the spacer tubes 716 that span between the outer vertical assembly flange 722 and the inner vertical assembly flange 722. In addition to providing guidance to the bolts during assembly, the tubes 716 provide additional structural rigidity between the inner and outer flanges 722 and increase the overall rigidity and longevity of the fire pit 110.

Figure 14:
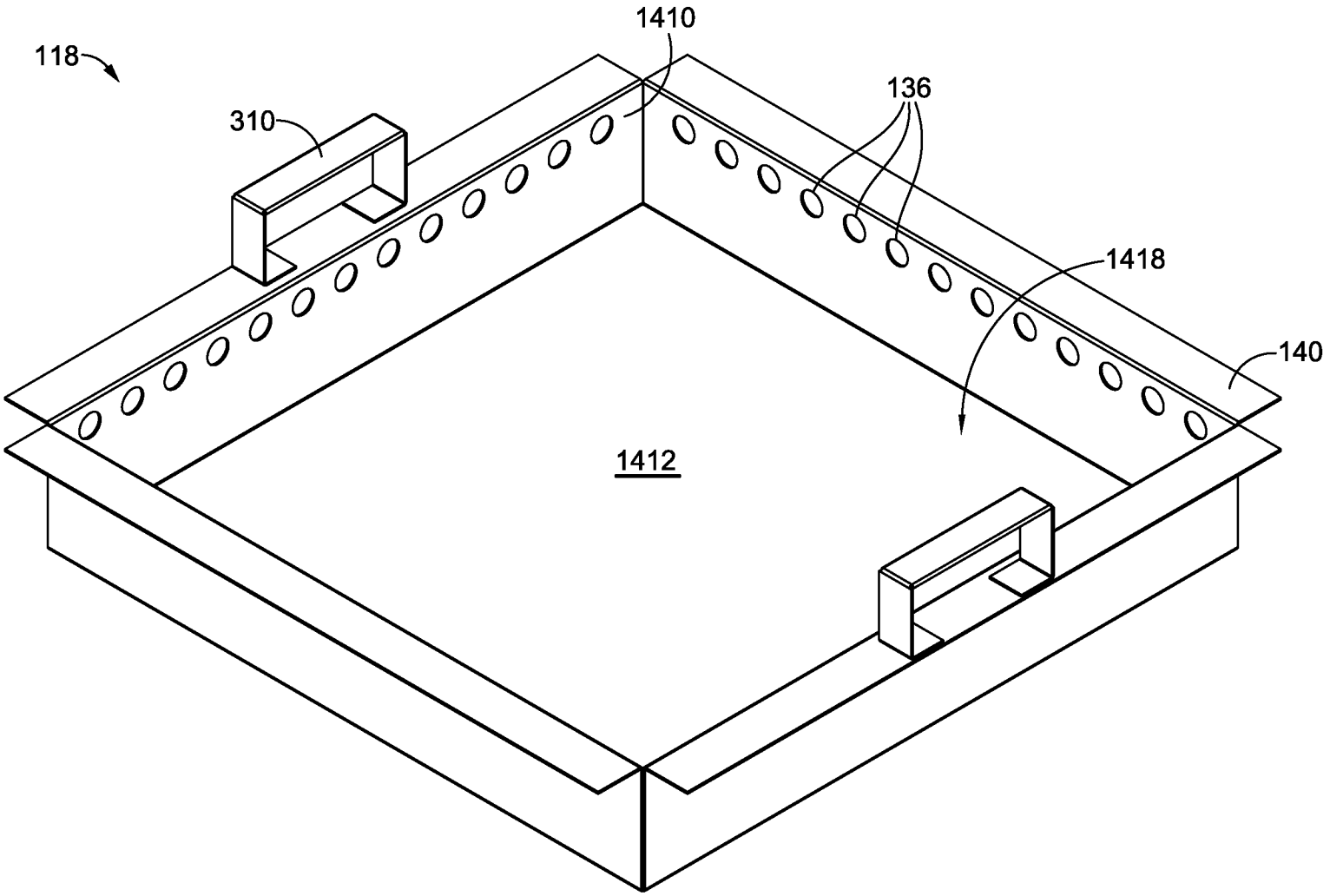
FIG. 14 is a top perspective view of the ash catch of the fire pit of FIG. 1.

FIG. 14 illustrates a top perspective view of the burn pan or ash catch 118. In embodiments, the ash catch 118 includes a set of sidewalls 1410 rising from a base 1412. The support flanges 140 extend outward from one or more of the sidewalls 1410 and are configured to rest on top of the flange 124 of the fire pit 110. The handles 310 permit the user to lift the ash catch 118 out of the burn chamber 114 through the upper end 126 of the burn chamber 114 and may be coupled with two of the support flanges 140, as shown in FIG. 14. The plurality of airflow openings 136 allow air to flow into an ash chamber 1418 of the ash catch 118. The airflow into the ash chamber 1418 helps feed the fire above the ash chamber 1418 (specifically, atop the grate 116.

Figure 17:
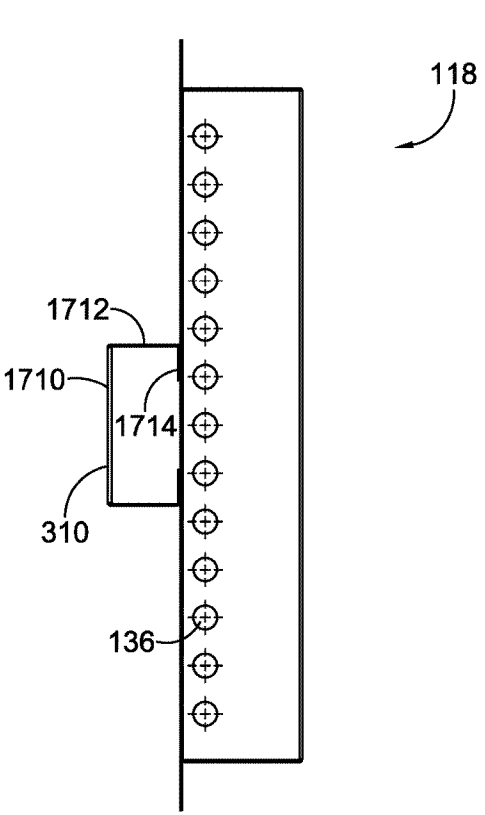
FIG. 17 is a side elevation view of the ash catch of FIG. 14.
Figure 15:
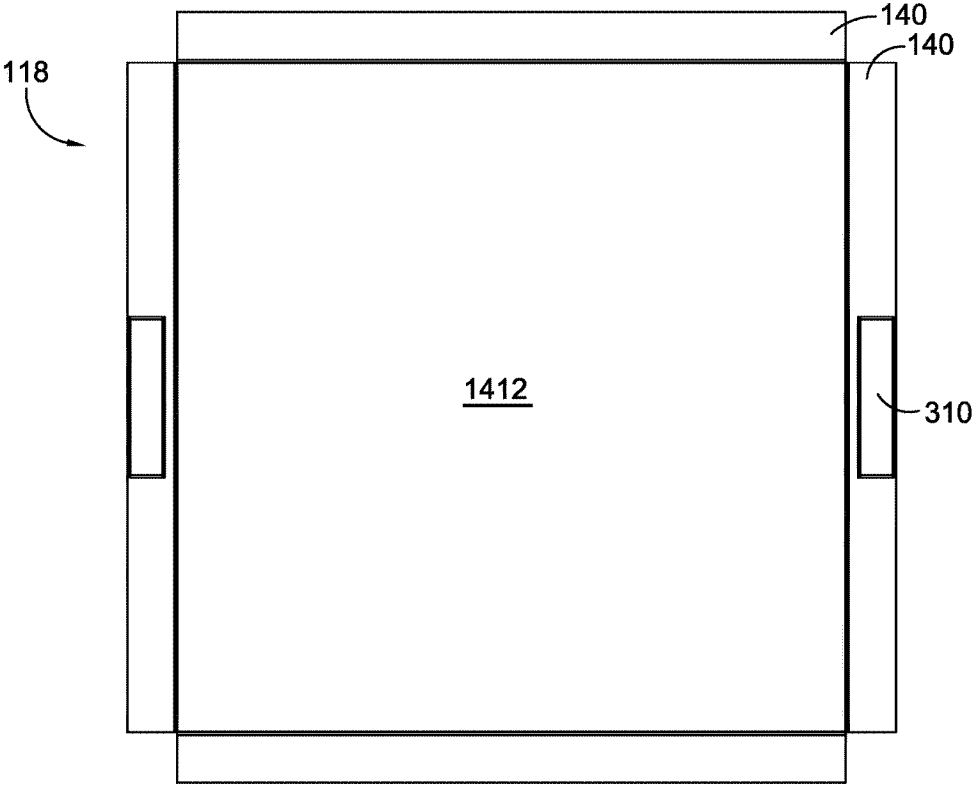
FIG. 15 is a top plan view of the ash catch of FIG. 14.
Figure 16:
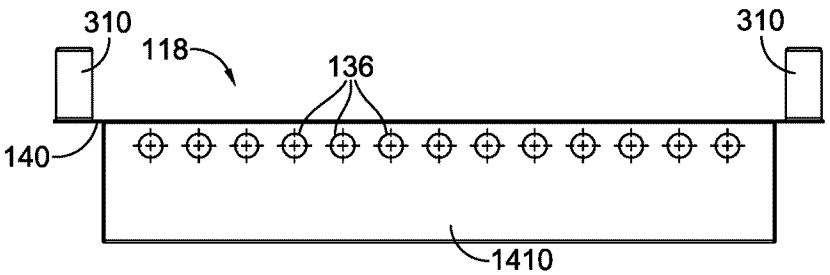
FIG. 16 is a front elevation view of the ash catch of FIG. 14.

FIG. 15 is a top plan view of the ash catch 118. As can be seen, in embodiments the ash catch 118 is generally square shaped. In other embodiments, the ash catch 118 may be another shape. FIG. 16 is a front elevation view of the ash catch 118 and FIG. 17 is a right side elevation view the ash catch 118. As can be seen, the handle of the ash catch 118 may rise from the support flange 140. As shown in FIG. 17, the handle may include a traversing member 1710 configured to be grasped by the user. The traversing member 1710 spans between two extending members 1712 that rise from the support flange 140. The traversing members 1712 are each secured to the support flange via a base member 1714. The traversing member 1710, extending members 1714, and support flange 1414 present a general rectangular shape, as best shown in FIG. 17, configured to receive a hand of the user for removal of the ash catch 118.

Figure 18:
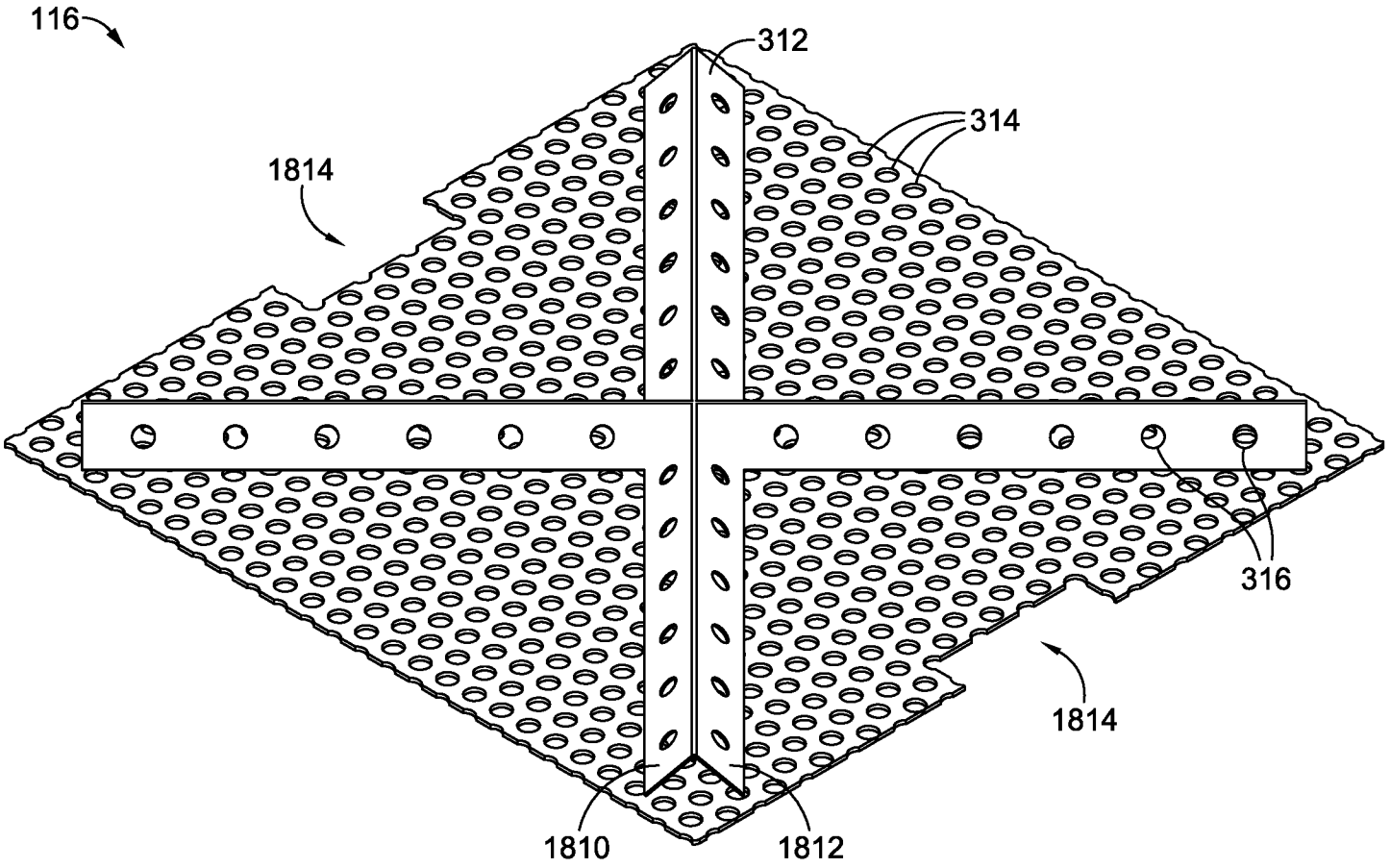
FIG. 18 is a top perspective view of the grate of FIG. 1.

FIG. 18 is a perspective view of the grate 116 with the structural support cross arms 312 thereon. It should be appreciated that some embodiments may not include the structural support cross arms 312, or they may be included on an underside of the grate 116. The structural support cross arms 312 provide increased rigidity to a thin metal grate 116. The structural support cross arms 312 thus assist in supporting a heavy fuel (e.g., logs) being placed inside the fire pit 110 to be burned. The structural support cross arms 312 may be formed of a left arm segment 1810 and a right arm segment 1812. The left and right arm segments 1810, 1812 may be disposed at a ninety-degree angle relative to each other, and each disposed at a forty-five degree angle relative to the grate 116. The left and right arm segments 1810, 1812 may each include one or more openings 316 to allow ash and air to pass there through. Also shown in FIG. 18 are a pair of recesses 1814 that allows the handle 310 of the ash catch 118 to pass. As such, when the user removes the ash catch 118, the grate 116 will also be removed as the grate 116 rests at least in part on the support flange 140 of the ash catch 118, as shown in FIG. 22.

FIG. 19 is a perspective view of one of the wall panels 112 of the illustrated embodiment with a portion of the interior wall segment 120 cut away to reveal an airflow chamber 1910 formed between the inner wall 120 and the exterior wall 122. Positioned in the airflow chamber 1910 are the plurality of gussets 1912. In the illustrated embodiment, the gussets 1912 do not run all the way from the top of the base 134 up to the upper end 126 of the wall panel 112 but instead only run a portion of the way up the interior of the wall panel 112. This permits air to move around inside the wall panel 112. However, in another embodiment, the gussets 1912 may go all the way to the top or may be omitted completely. The airflow chamber 1910 may include vertical air passageways 1914 that lead between the gussets 1912 and to air input passageways 1916 through the airflow openings 130. The airflow chamber thus allows air to flow up through the wall panel 112 and into the burn chamber 114 to feed the fire therein.

It should be appreciated that while two gussets 1912 are illustrated in FIG. 19, more or fewer gussets may be used in embodiments of the invention. In the illustrated embodiment, a third gusset (visible in FIGS. 4, 11, and 24) is disposed under a right side of the wall panel 112. The three gussets provided in the dual wall chamber between the exterior wall segment 122 and interior wall segment 120 of the wall panel 112 provide structural rigidity thereto.

Figure 21:
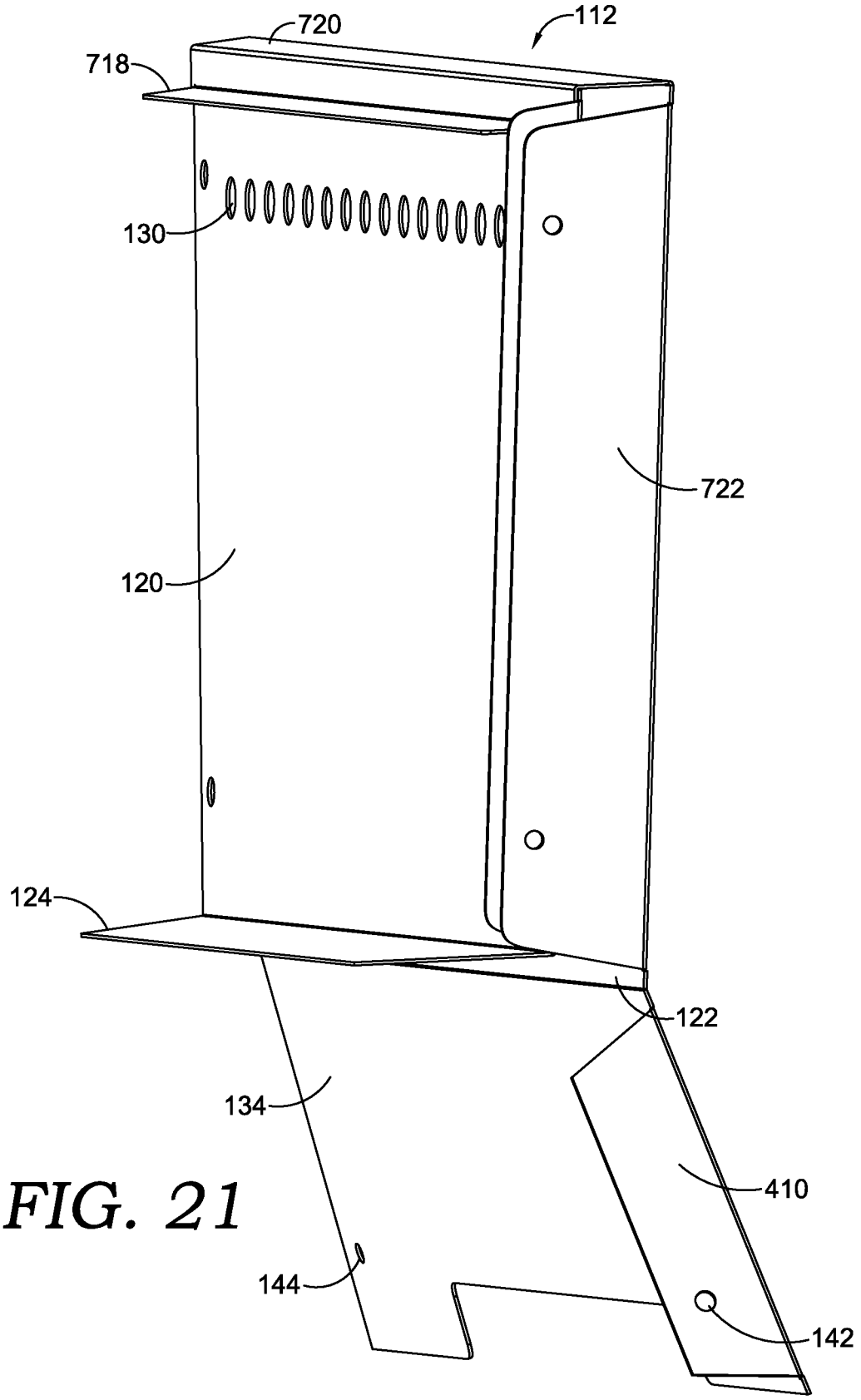
FIG. 21 is a top right perspective view of the side wall of FIG. 7 from a seventh angle showing two respective flanges.

FIGS. 20 and 21 are perspective views similar to the elevation view of FIGS. 12 and 13. While a wall panel 112 may be formed from the bending of a single sheet of sheet metal, in the illustrated embodiment, the interior wall segment 120 is formed from a first sheet 2010 (e.g., formed of sheet metal) and the exterior wall segment 122 is formed from a second sheet 2012 (e.g., formed of sheet metal). Regarding the second sheet 2012, the exterior wall segment 122 includes the lower end 128 bent outwardly that forms the base 134, transitions at a bend 146 to define the exterior wall segment 122, transitions at an upper edge 148 with an approximate right angle to form the flat upper surface or outer flange 720 of the wall panel 112, and is then bent downwardly at bend 150, which defines a thickness of the wall panel 112. The metal is then bent again at a generally right angle at bend 152 to form the upper flange 718 which sticks inwardly towards the burn chamber 114. The upper flange 718 directs the flow of heated air out of the airflow openings 130 at the upper end 126 of the interior wall segment 120 back into the burn chamber 114 to help create the double burn. The upper flange 718 may also be used to support a grill to be placed above the burn chamber 114 to permit the user to use the fire pit 110 to cook food.

Regarding the first sheet 2010, the upper end 126 of the interior wall segment 120 is coupled to the portion of the second sheet 2012 that extends downwardly from the upper surface 720 before turning to the inward flange 718 (i.e., the vertical portion between bends 150 and 152). The lower end 128 of the interior wall segment 120 is turned inwardly to define the support 134 124 for the ash catch 118.

FIG. 22 is a front side elevation view of the fire pit 110 of FIG. 1, but with the front side panel 112 removed for clarity to show inside the assembled fire pit 110 and the burn chamber 114. Wall-assembly bolts 2210 are disposed through a wall panel 112 and into an adjacent wall panel 112. Base-assembly bolts 2212 are disposed through the base into the securing tab 410 of an adjacent wall panel 112. The wall assembly bolts 2210 that are used to assemble the removed front side panel to the left side panel are still visible, but the tubes 716 that they pass through were removed when the front wall panel 112 was omitted, for clarity. The wall-assembly bolts 2210 may include a bolt body 2214 and a nut 2216. The base-assembly bolts 2212 may include a bolt body 2218 and a nut 2220. The bolt bodies 2214, 2218 are slid through the respective openings and the nuts 2216, 2220 are rotationally placed onto a distal end of the bolt body 2214, 2218 so as to secure the nuts 2216, 2220 to the bolt bodies 2214, 2218. In this way, the fire pit 110 110 may be easily assembled by the end user, to allow for the fire pit 110 110 to be shipped in a disassembled form.

Figure 23:
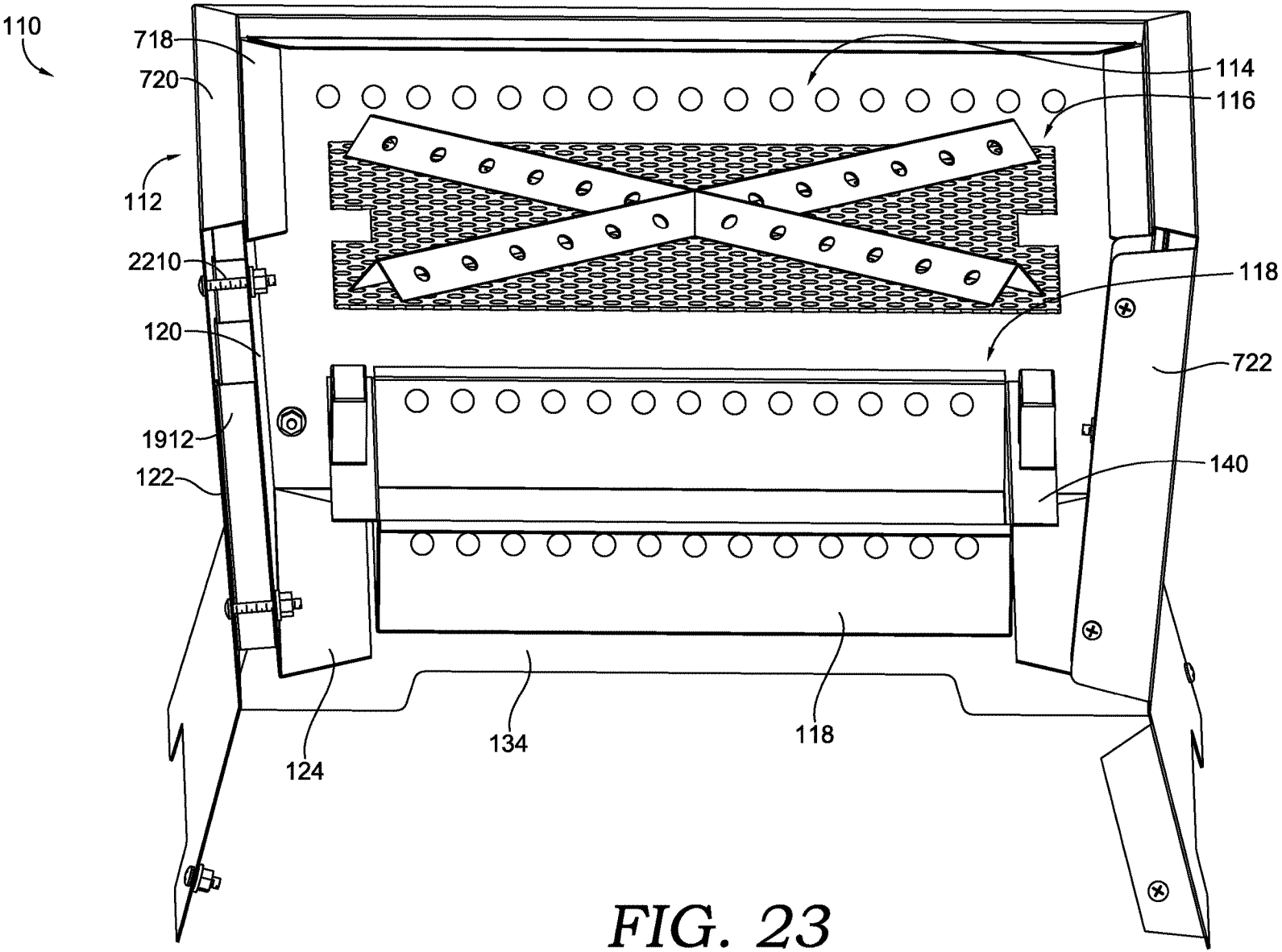
FIG. 23 is a front-top top view of the fire pit of FIG. 22, having the grate and the ash catch raised in a partial exploded view fashion to show how components fit together.

FIG. 23 is the same fire pit 110 of FIG. 22 but from a downward angle. Further, the ash catch 118 has been partly lifted up as if being removed from the fire pit 110 from the top opening thereof to dispose of ash or contents contained therein. Further, the grate 116 that sits on top of the ash catch 118 during use has also been lifted up even higher to provide greater visibility of the construction of the interior of the firebox and the manner in which the grate 116 sits on the ash catch 118 and the ash catch 118 sits on the ledge 124 formed by the flanges of the lower end 128 of the interior wall segment 120 of each wall panel 112.

FIG. 24 is a top plan view of the illustrated fire pit 110 in cross-section to permit the viewing of the area between the interior wall segments 120 and the exterior wall segment 122 of each wall panel 112, with the grate 116 and ash catch 118 removed. This view illustrates that the bottom of each wall panel 112 is open to permit air to flow up underneath the fire pit 110 and up through the air chambers 1910 defined by the dual wall construction. The spacing is assured through the gussets 1912 and the tubes 716. Air may flow under the fire pit 110 from outside of the fire pit 110 by going under the cutout portion 500 in the base 134 section of the wall panels 112 and then may flow through the airflow openings 136 around the upper periphery of the sidewalls 1410 of the ash catch 118 into the burn chamber 114 itself. Air may also flow up under the base 134 and then up through the dual wall construction 112. As it flows up through the dual wall passage, it is heated. As it is heated, it begins to rise faster and is then redirected through the airflow openings 130 back into the burn chamber 114 to further fuel combustion of the material therein.

Accordingly, the illustrated embodiment provides an assemblable dual wall fire pit 110. The fire pit 110 may be shipped flat and unassembled to reduce its size. It may then be readily assembled by a user by connecting the four wall panels 112 together. Additional wall panels 112 may be used to create fire pits 110 of other shapes such as a pentagon, a triangle, an octagon, etc. The ash catch 118 may be readily removable by lifting up through the top of the assembled fire pit 110, thereby making for easy removal of the ash without disassembly of the fire pit 110. The ash catch 118 may be of any shape or size to correspond with the opening of the fire pit 110. The ash catch 118 may also be used with or without the grate 116 thereon. Combustible material may be placed directly in the ash catch 118, if so desired. The grate 116, however holds the combustible material up off the bottom of the ash catch 118 to provide for greater circulation of air there around during combustion, thereby resulting in improved combustion.

In embodiments, the construction of the individual wall panels 112 also provides for a uni-body design by having both the base portion integrally formed with the sidewalls to define both the legs, the sidewalls, and upper and lower support areas all in a single wall panel. The construction also provides for a simple but sturdy tongue and groove (or mortise and tenon) type connection between adjacent wall panels 112 with the assembly flanges of each wall panel acting as a tongue and the space between the interior wall segment 120 and the exterior wall segment 122 defining the groove into which the tongue of an adjacent wall panel 112 is received for assembly.

In embodiments of the invention, an end user may assemble the fire pit 110. The user may secure a first wall panel 112 and a second wall panel 112. The user may align the first wall panel 112 with the second wall panel 112, such that one or more bolts may be placed through a component of the first wall panel 112 and a component of the second wall panel 112. The bolt may then be secured with a nut to hold the first wall panel 112 securely to the second wall panel 112. The user may then continue so as to secure the second wall panel 112 to a third wall panel 112, the third wall panel 112 to a fourth wall panel 112, and the fourth wall panel 112 to the first wall panel 112. Once all of the wall panels 112 are assembled, the user may insert the ash catch 118 and the grate 116 into the burn chamber 114. Further, the user may insert a fuel, such as wood pellets, into the burn chamber 114. The user may then apply a fire starter to the fuel in order to start a fire. A fire starter may include an electric fire starter, a chemical fire starter (not recommended), a fire source (such as a lit match or a lit lighter), or the like. As heated air rises through the wall panels 112, it flows into the burn chamber 114 at a top end. The heated air coming into the burn chamber 114 may prompt a secondary flame or secondary burning of the fuel.

Figure 25:
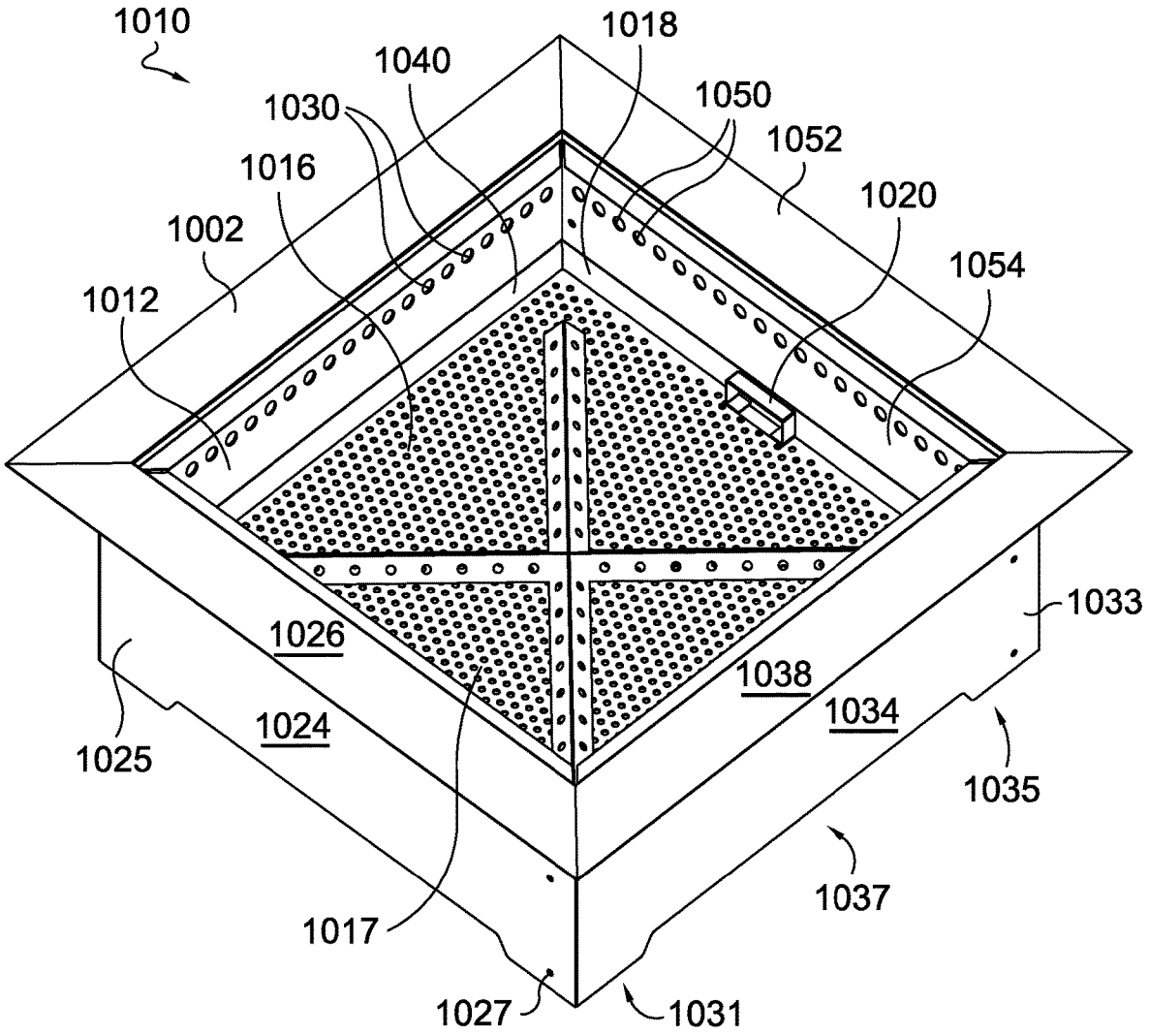
FIG. 25 is a top perspective view of an embodiment of a fire pit insert in accordance with aspects herein.
Figure 26:
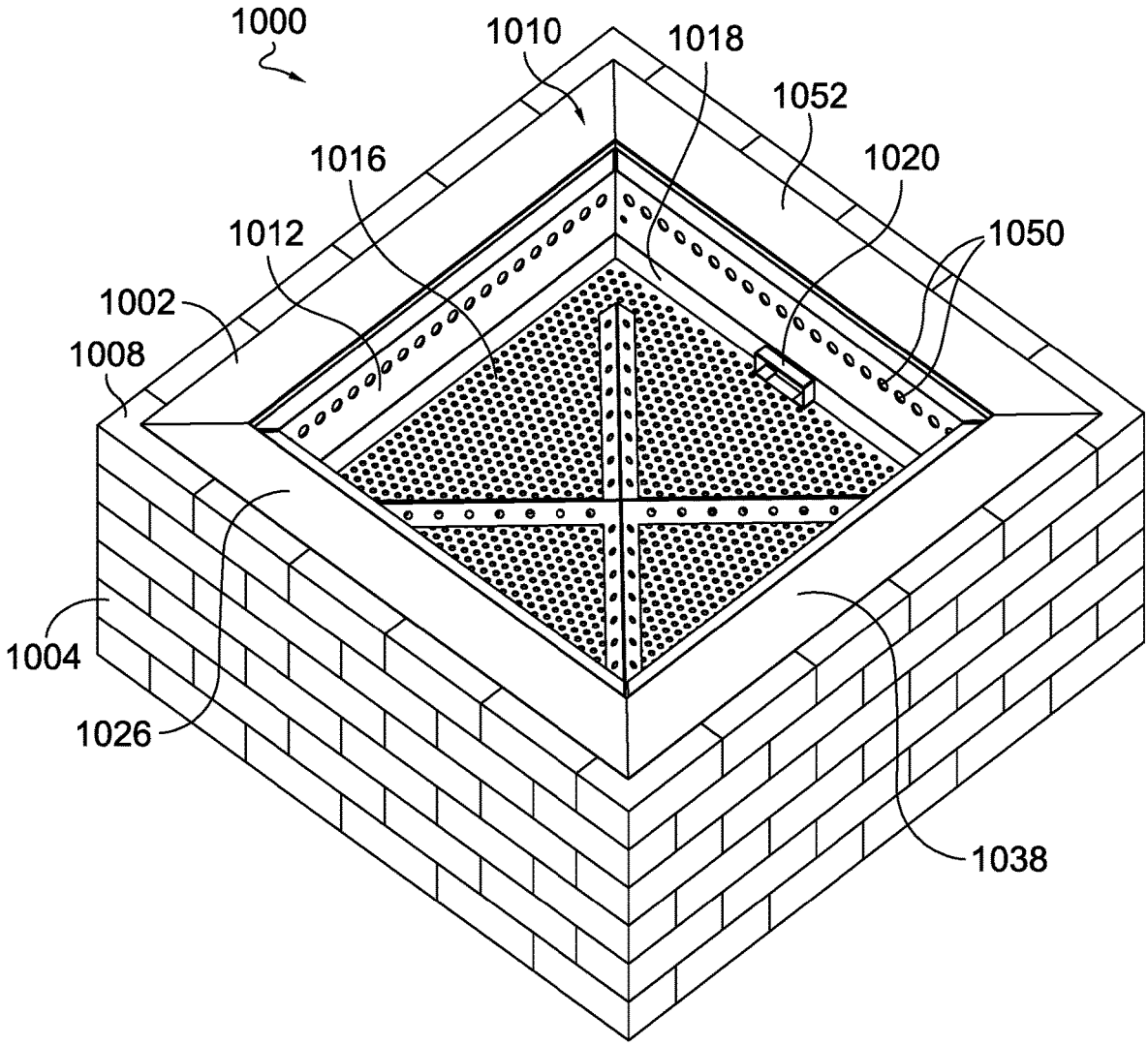
FIG. 26 is a top perspective view of the fire pit insert of FIG. 25 placed within a surrounding enclosure.

In further embodiments, a fire pit insert 1010 shown in FIGS. 25-28 may be provided for an end user to assemble similar to the fire pit 110 described above. In embodiments of the invention, an end user may acquire a packaged fire pit insert 1010 in a disassembled state. The end user may then assemble the fire pit 1010 upon removing the components from the packaging. The components may be assembled via various methods as described herein. The assembled fire pit 1010 may thus be assembled and disassembled as needed by the end user. FIG. 25 illustrates a top perspective view of an example fire pit insert 1010. In FIG. 26, the fire pit insert 1010 has been inserted into an enclosure 1004, completing a fire pit 1000 structure. In the illustrated embodiment, the enclosure 1004 is made of bricks; however, it could be made of other materials, such as stone, concrete blocks, pavers, or the like. As mentioned, in additional to an assemblable fire pit described above, it is also beneficial for consumers to have the option of an assemblable fire pit insert such as fire pit insert 1010 shown in FIG. 25. An insert as described herein allows consumers to customize the build of their fire pit without having to customize the actual fire pit insert 1010. As shown in FIG. 26, the fire pit 1010 may be surrounded by a brick enclosure 1004, thereby allowing a user to obtain the benefits of a dual wall fire pit construction along with the look of a traditional stone, brick, or paver enclosure.

Similar to the fire pit 110, the fire pit insert 1010 is assembled from a plurality of wall panels 1012, 1024, 1034, and 1054, each with air openings 1030, 1041, 1048, and 1050. The wall panels would generally be packaged together in a container (e.g., a cardboard box) in an abutting arrangement (e.g., stacked on top of or side by side each other) to minimize the space needed to package the wall panels, the cost of shipping, and the amount of retail space needed to display the packaged fire place insert 1010. A consumer would then unpackage the container and remove the ready to assemble wall panels. Additionally, as shown in FIG. 25, the fire pit insert 1010 includes an ash catch 1018 having a flange 1040, a grate 1016, and four removable rim portions 1002, 1026, 1038, and 1052. Each of the removable rim portions are removably connected to each wall panel, such as wall panel 1024. Once assembled, each rim portion 1002, 1026, 1038, and 1052 extends outward perpendicular to its respective wall panel (i.e., wall panels 1012, 1024, 1034, and 1054, respectively). When the fire pit insert 1010 is inserted into the example brick enclosure 1004 of FIG. 26, the rim portions 1002, 1026, 1038, and 1052 rest on a top surface 1008 of the brick enclosure 1004.

Figure 27:
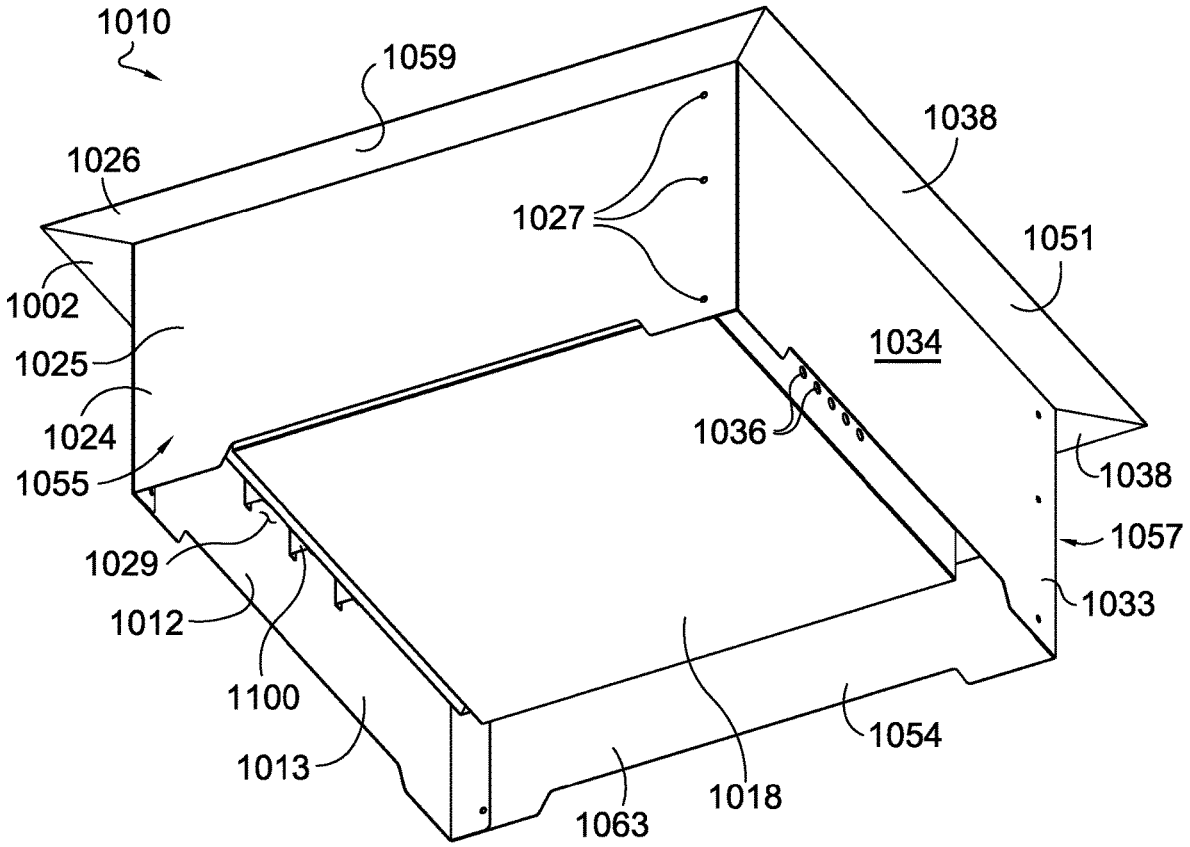
FIG. 27 is a bottom perspective view of the fire pit insert of FIG. 25.

As shown, the fire pit insert 1010 comprises four wall panels, such as wall panel 1012, that are removably connected to one another. Additionally, the wall panels 1012, 1024, 1034, and 1054, once assembled, such as illustrated in FIGS. 25 and 27, define a burn chamber 1017 there between. Any of various fuels and/or heat sources may be placed within the burn chamber 1017 on top of the grate 1016 to be burned. The grate 1016 sits on top of the removable fire pan or ash catch 1018. As previously discussed, ash and other debris from the burning fuel may fall through the grate 1016 and into the ash catch 1018 during operation. The ash may then remain in the ash catch 1018 until the ash catch 1018 is removed by an end user for disposal. The ash catch 1018 also allows for the ash to be selectively removed from the burn chamber 1017 so as to not hamper the burning process. This allows for a more clean burn in the burn chamber 1017.

Figure 28:
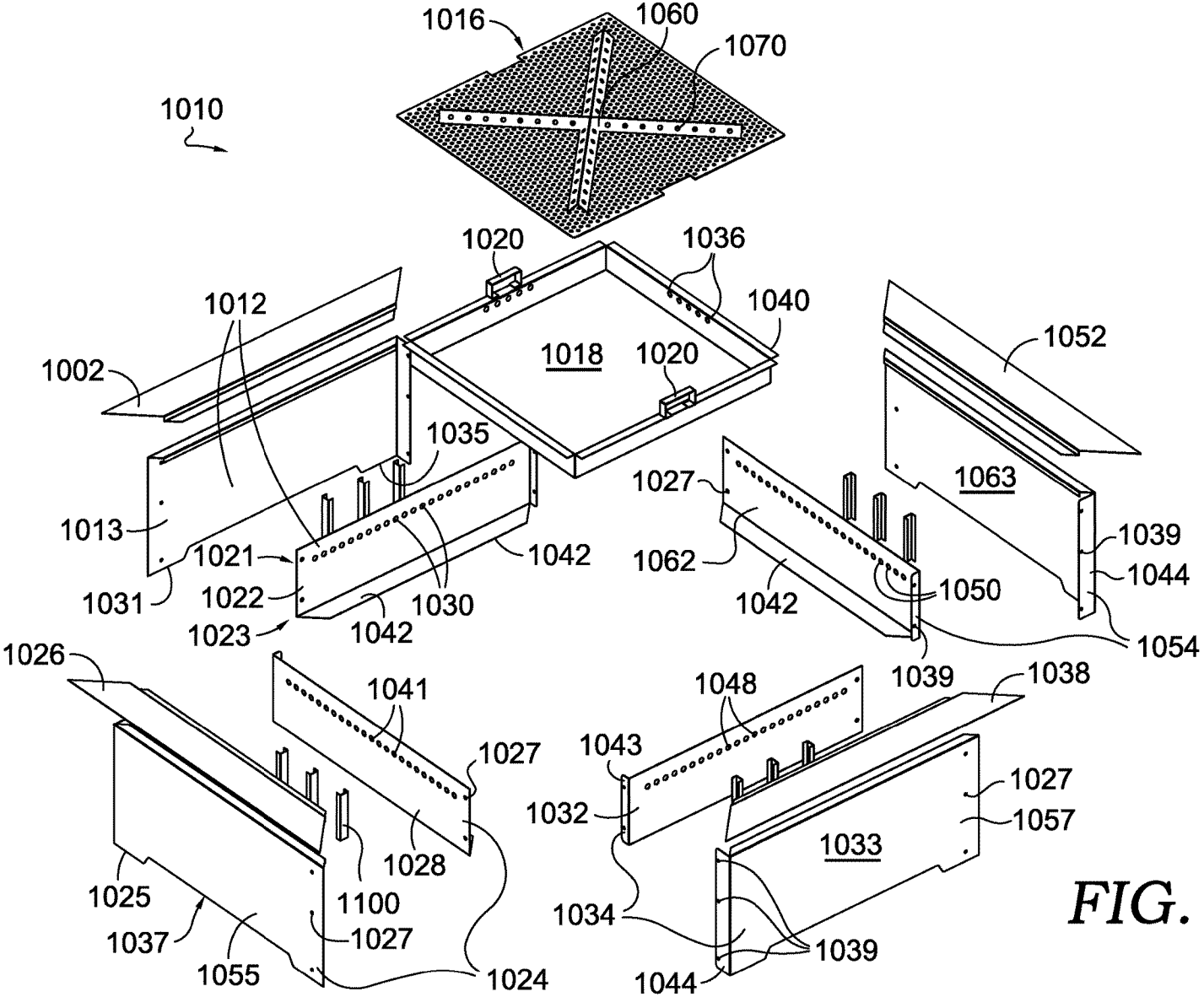
FIG. 28 is an exploded perspective view of the fire pit insert of FIG. 25.

In embodiments, and shown in FIGS. 27 and 28, each wall panel 1012, 1024, 1034, and 1054 includes an interior wall segment, such as interior wall segment 1022 (shown in FIG. 28), and an exterior wall segment, such as exterior wall segment 1013. The interior wall segment 1022 of the wall panel 1012 may include a lower support or flange 1042 extending into the burn chamber 1017 to support at least one of the grate 1016 and the ash catch 1018. The interior wall segment 1022 has an upper end 1021 and a lower end 1023. The upper end 1021 may include one or more airflow openings 1030 to permit air to move from between the walls 1022 and 1013, through the airflow openings 1030, and into the burn chamber 1017. During operation, primarily due to convection, air is drawn up into the wall panel 1012 at the lower end 1023, which is open toward the ground. The air, as it is heated, rises up through an interior 1029 of the wall panel 1012, between the inner wall 1022 and the outer wall 1013, and out into the burn chamber 1017 through the airflow openings 1030 at the upper end 1021. Securing openings 1027 are provided at one end of each wall panel (e.g., 1024) for securing it to an adjacent wall panel (e.g., 1034), as discussed in more detail below.

The wall panels (e.g., 1034) may include, at an end opposite the securing openings 1027, inner and outer interlocking flanges 1043 and 1044, respectively. The interlocking flanges 1043, 1044 both include holes 1039 therein that not only align with each other, but when the wall panels are mated together, align with the securing openings 1027 in an adjacent panel, whereby a bolt or fastener may be received therein to securely couple adjacent panels together. The holes 1039 in the interlocking flanges 1043, 1044 can be spaced apart by a tube positioned between the interlocking flanges 1043, 1044 and coaxial with the aligned holes 1039 in the adjacent interlocking flanges 1043, 1044 so the holes 1039 and the tube form a passageway for the user to place a bolt in during assembly. The tubes, which are optional, direct the bolt from one hole 1039 to the next hole 1039 on an opposite flange so the distal end of the bolt does not get "lost" inside the wall panel (e.g., 1012) during assembly, as discussed above. The user aligns the holes 1039 with the securing openings 1027 and places a bolt there through to couple adjacent panels.

The metal sheet material can be laser cut while flat before the bending occurs. The holes 1039 and securing openings 1027 for the bolts, as well as the airflow openings (e.g., 1030), can be cut out at the same time. The metal sheet material may be bent back upon itself to form the dual wall construction, or each wall may be formed on its own.

It is contemplated that in some embodiments, the wall panels 1012, 1024, 1034, and 1054 may be identical in size, shape, and construction, for ease of manufacture and assembly. In other embodiments, the wall panels 1012, 1024, 1034, and 1054 can vary from one to another for a particular design. The wall panels 1012, 1024, 1034, and 1054 may be formed from metal sheet material bent to provide a dual-wall structure. A first portion of the interior wall segment 1022, 1028, 1032, and 1062 near the lower end 1023 may be bent inwardly to form the ledge or flange 1042 upon which the fire pan or ash catch 1018 may be supported in use.

As shown in FIGS. 25-28, the lower portion of the wall panels 1012, 1024, 1034, and 1054 is not bent outwardly to form a base 134, which is different from the embodiment described in FIG. 1. More specifically, the lower portion of the wall panel 1012 remains straight and is not bent in any direction. This permits it to be inserted into the enclosure 1004. The wall panels 1012, 1024, 1034, and 1054 include two projecting portions or legs 1031 and 1035 that extend vertically further than a middle recessed portion 1037. The recessed portion 1037 allows for unevenness in the underlying surface to not affect the stability of the wall panel when free standing. It also permits air outside the fire pit insert 1010 to flow up under the fire pit insert 1010 and into the interior 1029 of each wall panel 1012, 1024, 1034, and 1054 during use to feed the combustion with air, as characteristic of dual wall fire pit systems. With the legs 1031 and 1035 and recessed portion 1037, the wall panels 1012, 1024, 1034, and 1054 do not need to be supported by an exterior object in order to remain upright. Instead, the fire pit insert is self-supporting and can be used alone or inserted into a surrounding enclosure, like the brick enclosure 1004. The plurality of airflow openings 1030, 1041, 1048, and 1050 also assist with the double burn found in smoke-free or reduced-smoke fire pit system with a double wall construction, as previously discussed.

Turning back to FIG. 27, a bottom perspective view of the fire pit insert 1010 is shown. A bottom surface of the ash catch 1018 can be seen. The grate 1016 is located above the ash catch 1018 but cannot be seen, as the ash catch 1018 is obstructing it. Additionally, an exterior surface 1055 of outer wall 1025 of panel 1024 and an exterior surface 1057 of outer wall 1033 of panel 1034 are shown. A bottom surface 1059 of the rim portion 1026 and a bottom surface 1051 of the rim portion 1038 are also illustrated. As can be seen, wall panels 1024 and 1034 have been removably coupled together. Securing openings 1027 are shown where fasteners secure wall panels 1024 and 1034 together. A plurality of gussets 1100 are also visible in the interior 1029 of wall panel 1012. The gussets 1100 provide structural support to the wall panels 1012, 1024, 1034, and 1054. The gussets 1100 are located between the interior wall segments and the exterior wall segments.

Still in FIG. 27, the rim portion 1026 is coupled to the wall panel 1024 and the rim portion 1038 is coupled to the wall panel 1034. When inserted into a surrounding structure, such as the brick enclosure 1004 of FIG. 26, the bottom surfaces 1051 and 1059 of rim portions 1038 and 1026 will rest on the top surface 1008 of the brick enclosure 1004, as shown in FIG. 26. The double wall structure and opening through which air flows between the exterior wall segments and the interior wall segments of the wall panels 1012 and 1054 is also illustrated.

Next, FIG. 28 depicts an exploded view of the fire pit insert 1010 of FIG. 25. The topmost component is the grate 1016 with structural cross arms 1060 depicted thereon. The grate 1016 is configured to sit atop either the flanges 1042 of each wall panel 1012, 1024, 1034, and 1054 or the ash catch 1018. When the grate 1016 sits atop the ash catch 1018, at least one handle 1020 of the ash catch 1018 is accessible through or beside the grate 1016. In the illustrated embodiment the grate 1016 sits between and partially around the two handles 1020 of the ash catch 1018 such that the handles 1020 protrude up through or beside the grate 1016 to be accessed by a user, as seen in FIGS. 25 and 26. The user may remove the grate 1016 individually by grabbing the same or along with the ash catch 1018 by lifting upwardly on the handles 1020. While FIG. 28 illustrates an exploded view of the fire pit insert 1010, and in particular the wall panels 1012, 1024, 1034, and 1054, the wall panels would normally be fully assembled when packaged and shipped such that when the consumer removed them from the container they are ready to assemble and would look generally like the other embodiments wall panels depicted in FIGS. 6 and 33.

The grate 1016 may have a cross member 1060 for structural stability. The grate 1016 may be a wire mesh material or a metal plate with a plurality of openings there through to provide for the passage of air during the burning of the material placed inside the burn chamber 1017, as well as the passage of ash into the ash catch 1018. The grate 1016 may be reinforced with the cross member 1060 which, in the illustrated embodiment is in the shape of an angle iron. The arms of the cross member 1060 may have holes 1070 there through to further facilitate the passage of air from below the grate 1016 up through the grate 1016 and into the burn chamber 1017 during use. While FIG. 28 illustrates the fire pit insert with both the grate 1016 and ash catch 1018, it is possible, that in embodiments one or both of these components may not be utilized.

Immediately below the grate 1016 is the removable ash catch 1018. The ash catch 1018, includes a plurality of airflow openings 1036 around the upper portion thereof that allow air to come up from underneath the fire pit insert 1010 during use and through the ash catch 1018 to helped fuel the combustion of the material placed in the burn chamber 1017. A flange (or flanges) 1040 extends horizontally outward from one or more of the sidewalls of the ash catch 1018 and is designed to rest on the ledge 1042 created at the lower end 1023 of the inner sidewalls 1022, 1028, 1032, and 1062. Also visible are two handles 1020 that may be used to lift the fire pan or ash catch 1018 directly up out of the top of the burn chamber 1017 to dump or dispose of the ashes contained therein.

Located below the ash catch 1018 are four sets of wall panels 1012, 1024, 1034, and 1054 (shown as being identical in this embodiment, but may be different sizes and shapes in other embodiments) that each include interior and exterior wall segments. For example, wall panel 1012 comprises interior wall segment 1022 and exterior wall segment 1013. Wall panel 1024 comprises interior wall segment 1028 and exterior wall segment 1025. Wall panel 1034 comprises interior wall segment 1032 and exterior wall segment 1033. Wall panel 1054 comprises interior wall segment 1062 and exterior wall segment 1063. Each of the interior wall segments 1022, 1028, 1032, and 1062 have airflow openings 1030, 1041, 1048, and 1050, respectively.

While illustrated in FIG. 28 as four identical wall panels 1012, 1024, 1034, and 1054, in other embodiments they could be four (or more or less) distinct wall panels. Specifically, embodiments of the invention may include a first wall panel 1012, a second wall panel 1024, a third wall panel 1034, and a fourth wall panel 1054. As discussed herein, in embodiments, the first wall panel 1012 is identical to the second wall panel 1024, the third wall panel 1034, and the fourth wall panel 1054. In other embodiments, the first wall panel 1012 may be identical to the third wall panel 1034, while the second wall panel 1024 is identical to the fourth wall panel 1054 (with the first and third wall panels 1012 and 1034 having a different length than the second and fourth wall panels 1024 and 1054), thus forming a rectangular shaped fire pit insert.

Figure 29:
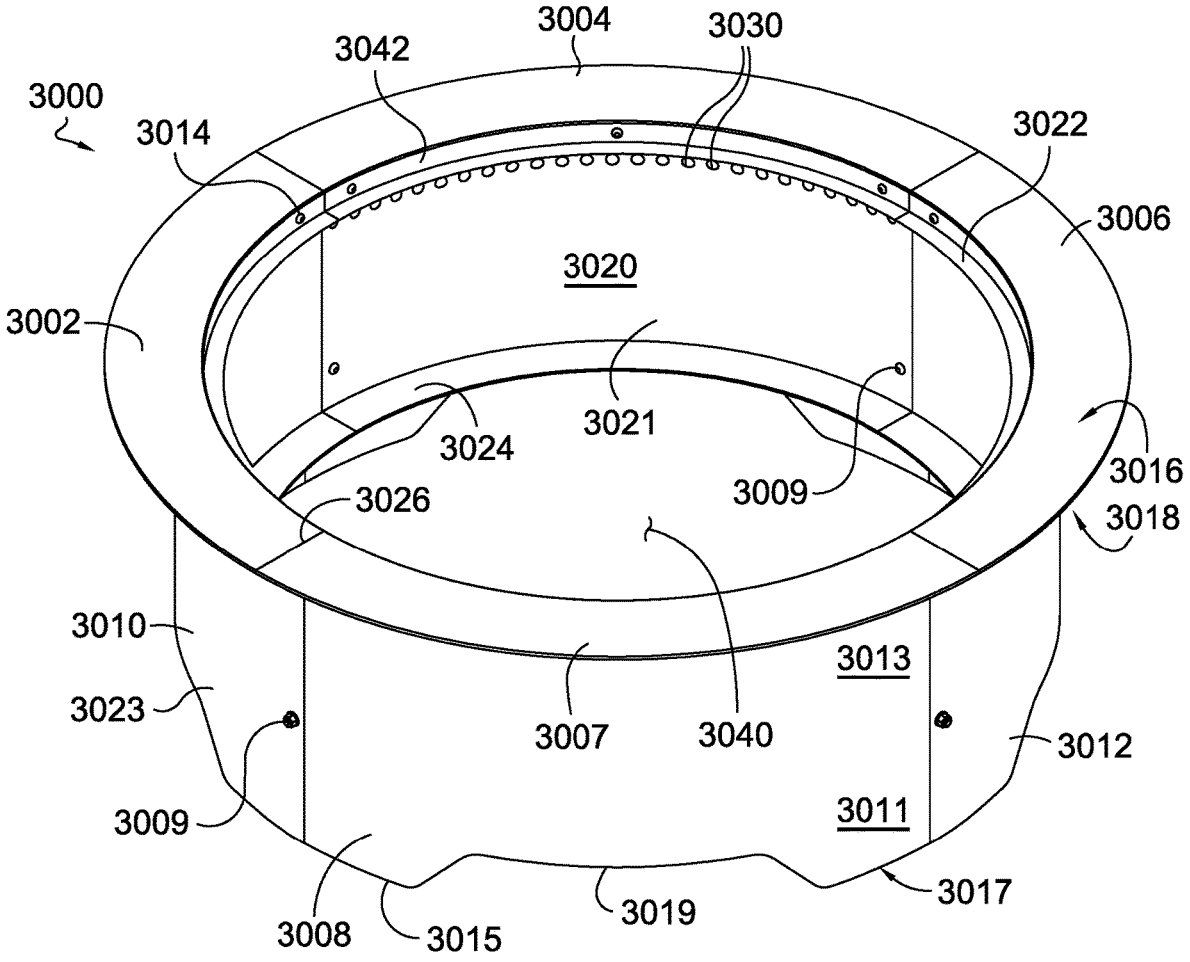
FIG. 29 is a top perspective view of another embodiment of a fire pit insert in accordance with aspects herein.

Turning to FIG. 29, an alternate embodiment of a fire pit insert 3000 is shown. The general function of the fire pit insert 3000 is similar to the assemblable fire pit and previous fireplace insert shown in FIGS. 25-28. As depicted, the fire place insert 3000 is round in shape, rather than square or rectangular, as was described above. It is contemplated that the features described herein of the fire pit insert are not limited to square or round fire pit inserts and that the shape of the inserts may vary.

Similar to the fire pit insert 1010 previously described, fire pit insert 3000 is comprised of four wall panels 3008, 3010, 3012, and 3020, each of which are arcuate in shape such that when all four wall panels 3008, 3010, 3012, and 3020 are coupled together they define a round fire pit insert. Each of the wall panels 3008, 3010, 3012, and 3020 are removably coupleable to one another via a fastener (e.g., a screw or bolt) 3009. Additionally, each wall panel 3008, 3010, 3012, and 3020, like the panels above, has an interior wall segment 3021 and exterior wall segment 3023 (shown in FIG. 34), with a flange 3024 at a lower end of the interior wall segment for an ash catch to rest upon. Further, each of the wall panels 3008, 3010, 3012, and 3020 comprise a top portion 3013 and a bottom portion 3011. The bottom portion has a cutout or recess 3019 that defines two legs 3015 and 3017. The recess 3019 allows for unevenness in the underlying surface to not affect the stability of the wall panel 3008, as well as permits airflow during operation from outside the fire pit insert 3000 up into a burn chamber 3040.

In addition to the wall panels, the fire pit insert 3000 also includes four rim portions 3002, 3004, 3006, and 3007. The rim portions 3002, 3004, 3006 and 3007 are removably secured to the wall panels 3010, 3020, 3012, and 3008, respectively. As previously described, the rim portions 3002, 3004, 3006 and 3007 rest upon a top surface of a surrounding enclosure, such as the top surface 3094 of the tumbled paver enclosure 3090 of FIG. 35. Each rim portion 3002, 3004, 3006 and 3007 comprises a top surface and a bottom surface, such as top surface 3016 and bottom surface 3018. The bottom surface 3018 rests on the enclosure top surface, such as the top surface 3094 of the tumbled paver enclosure 3090 of FIG. 35. Additionally, FIG. 29 shows the burn chamber 3040, the flange 3024 upon which the ash catch will rest, securement points where the rim portions 3002, 3004, 3006 and 3007 are secured to the wall panels, such as securement point 3014, and air openings 3030.

Figure 30:
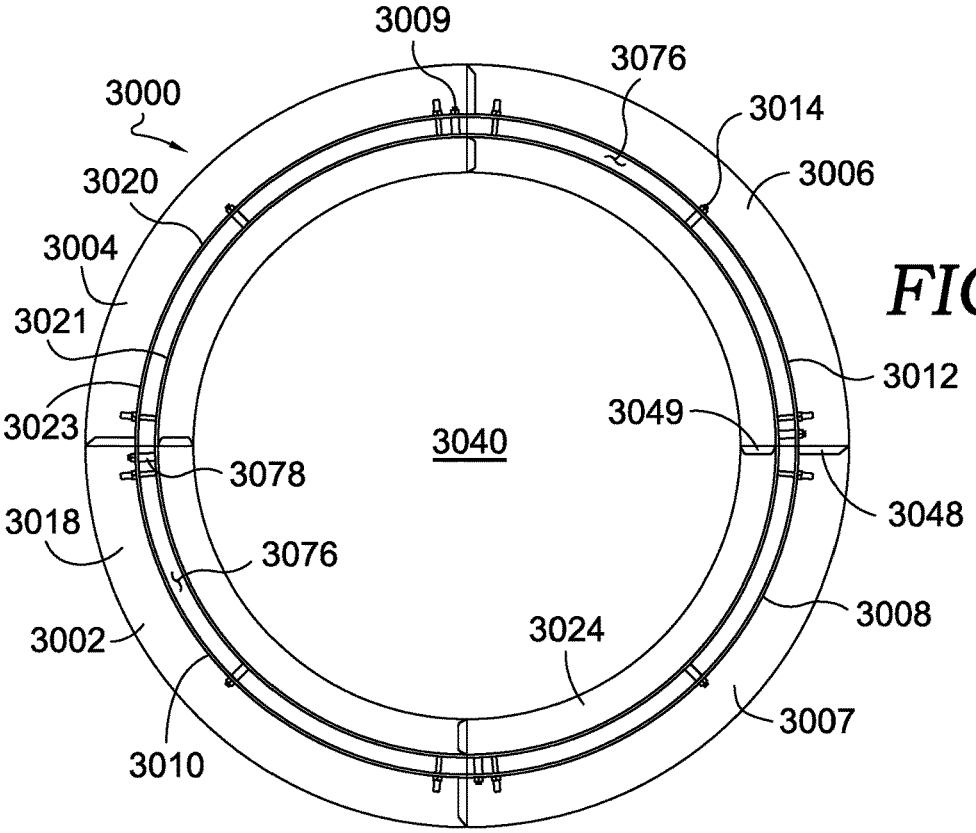
FIG. 30 is a bottom plan view of the fire pit insert of FIG. 29.

In FIG. 30, a bottom plan view of the round fire pit insert 3000 is shown. As one can see, in the illustrated embodiment, the four rim portions 3002, 3004, 3006 and 3007 are equal in size, but it is contemplated that in other embodiments, the size and shape of the rim portions and wall panels may not be uniform. In the illustrated embodiment, the four rim portions 3002, 3004, 3006 and 3007 are not mechanically fastened to each other, but are fastened to their corresponding wall panels 3010, 3020, 3012, and 3008, respectively, which are in turn fasted to each other. However, each end portion is provided with an inner tongue 3046 (FIG. 33) and an outer tongue 3048 at one end so the adjacent rim overlaps the tongues 3046 and 3048 when assembled to provide additional support to the entire rim once assembled.

Figure 31:
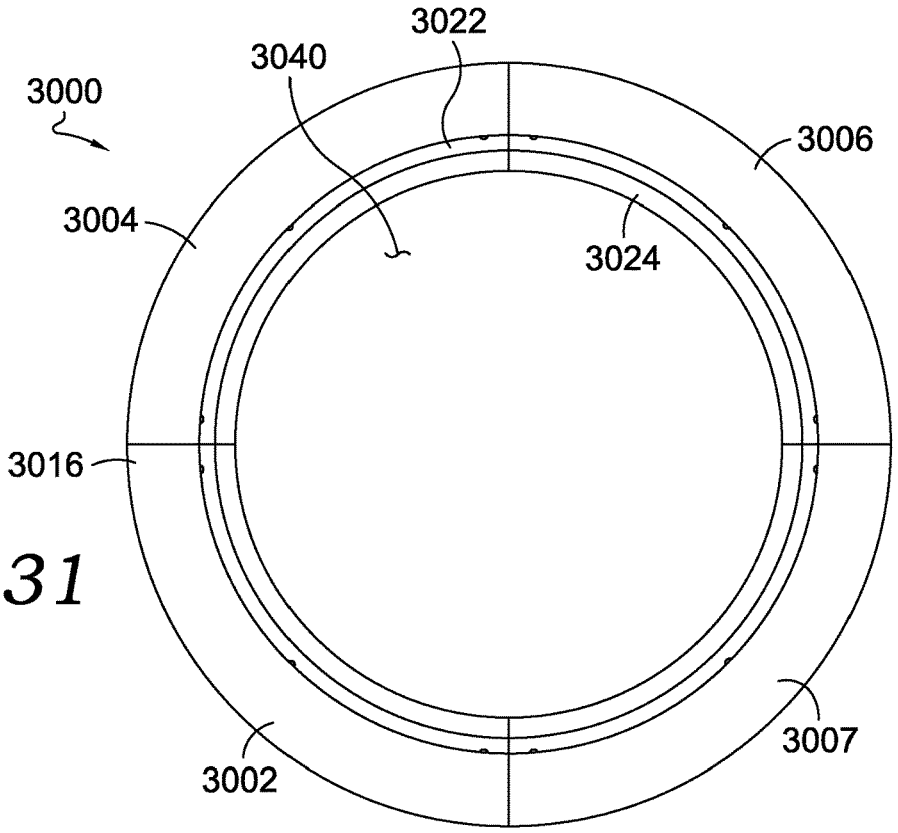
FIG. 31 is a top plan view of the fire pit insert of FIG. 29.

In FIG. 31, a top plan view of the round fire pit insert 3000 is shown. The top of the burn pit 3040 is shown. Additionally, the top surface of the rim portions 3002, 3004, 2006, and 3007 is shown. The bottom surface 3018 of each of the rim portions outside of the wall panels (FIG. 30) will rest on the surrounding enclosure when the fire pit insert 3000 is placed inside an enclosure 3090. Also shown is a ledge 3022 formed by each of the rim portions 3002, 3004, 2006, and 3007. The ledge 3022 extends around the periphery of and into the burn chamber 3040. The ledge 3022 may be used to support a grill (not shown) above the burn chamber 3040 to permit the user to use the fire pit 3000 to cook food. The flange 3024 at the lower end of the interior wall segments is also visible, as it extends further radially inward than the ledge 3022. This allows it to hold a round ash catch (not shown) of similar construction to the ash catch 1018. The round ash catch can be supported on the flange 3024 but still have an outer diameter smaller than and inner diameter of the ledge 3022, thereby permitting it to be lifted up and out of the burn chamber 3040.

Figure 32:
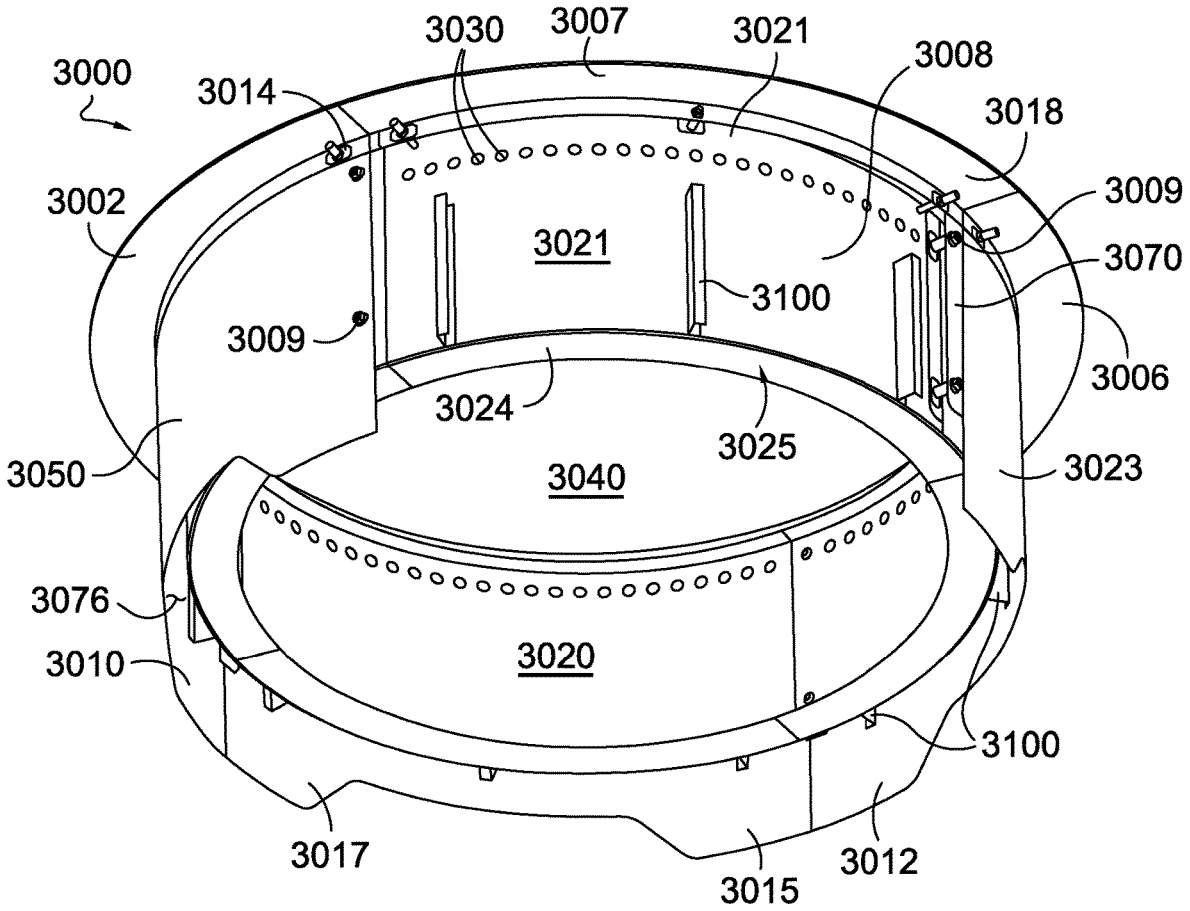
FIG. 32 is a bottom perspective view of the fire pit insert of FIG. 29 with an exterior wall removed for clarity.

Next, FIG. 32 illustrates a bottom perspective view of the round fire pit insert 3000. In this view, an exterior wall segment has been removed in order to show the two layer wall panel construction. As illustrated, the interior wall segment 3021 of the wall panel 3008 is exposed and comprises air openings 3030 through which air will travel when the fire pit is in use. Additionally, a bottom surface 3025 of the flange 3024 can be seen. The bottom surface 3025 will be spaced vertically above a ground surface upon which the fire pit insert 3000 is placed and the flange 3024 provides a resting location for the ash catch (not shown). An exterior surface 3050 of the wall panel 3010 is shown. The bottom surfaces 3018 of the rim portions 3002, 3006, and 3007 are visible. As mentioned, these surfaces will generally rest on a top surface of a surrounding enclosure, such as the tumbled paver enclosure 3090 of FIG. 35. Gussets 3100 are also visible.

Figure 33:
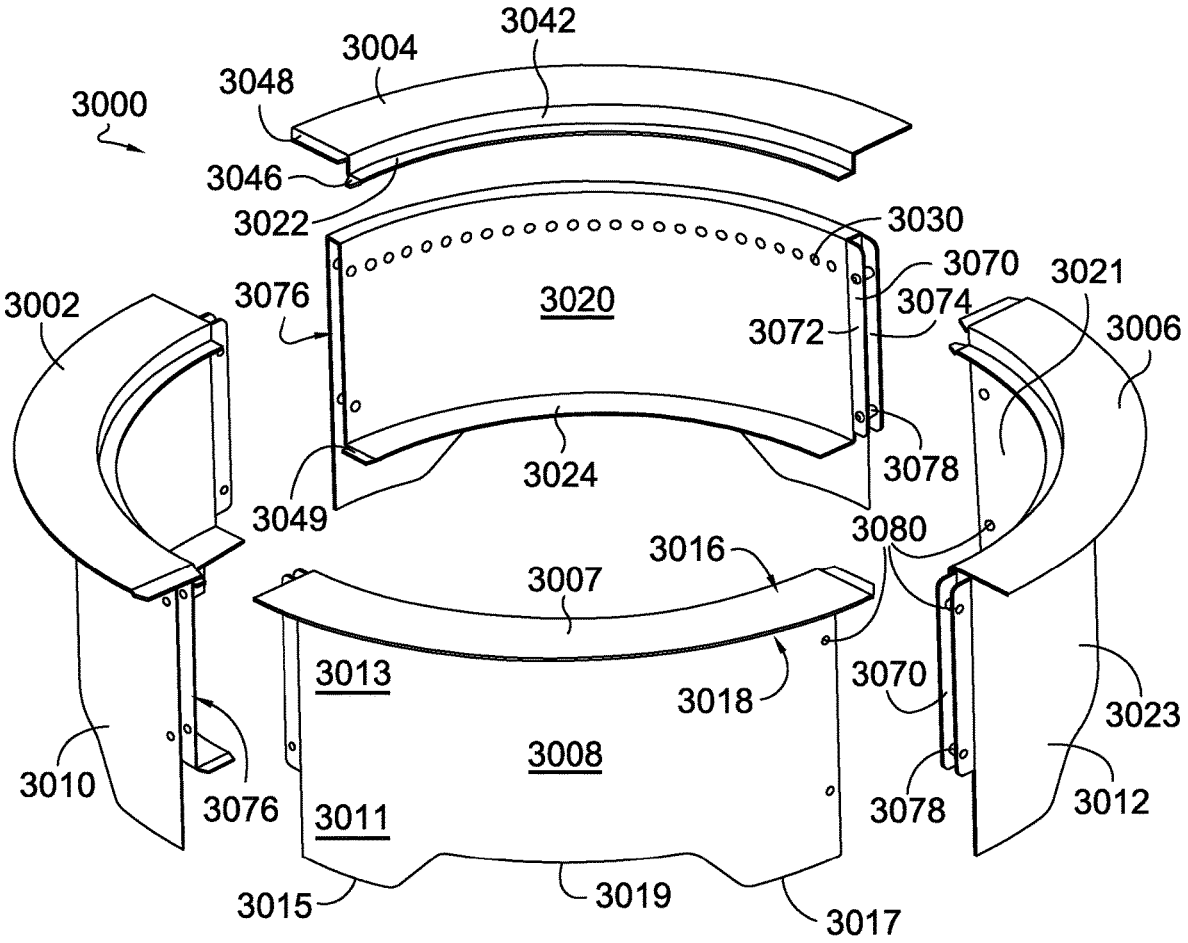
FIG. 33 is an exploded top perspective view of the fire pit insert of FIG. 29.

FIG. 33 illustrates an exploded top perspective view of the fire pit insert 3000. While not shown in the image, an ash catch and grate with the same features as discussed herein may be present in embodiments. In other embodiments, the fire place insert 3000 may be manufactured without these components. Beginning with the top of FIG. 33, the four rim portions 3002, 3004, 3006, and 3007 are shown. As mentioned, each of the rim portions 3002, 3004, 3006, and 3007 have the same shape and size in the illustrated embodiment. However, in other embodiments, the rim portions may not be uniform in size and shape. It is contemplated that a fully custom fire pit insert may be possible with any shape and size configuration as long as the dual wall construction remains.

As shown with respect to rim portion 3007, each rim portion comprises a top surface 3016 and a bottom surface 3018. The top surface 3016 remains exposed once the fire pit insert 3000 is inserted into a surrounding structure, like enclosure 3090, while the bottom surface 3018 rests upon a top surface 3094 of the surrounding structure. Additionally, each wall panel comprises a top portion 3013 and a bottom portion 3011. As previously discussed, the bottom portion includes a recess 3019 and two leg portions 3015 and 3017 which provide stability for the fire pit insert to remain standing when assembled and placed on the ground or placed within a surrounding structure like a stone or brick wall, like enclosure 3090. Each of the rim portions 3002, 2004, 2006, and 3007 also comprise a ledge 3022 that extends horizontally and radially inward. The rim portions 3002, 2004, 2006, and 3007 also include a vertical wall section 3042 that provides additional securement points between the rim portions and their corresponding wall panel, as seen in FIG. 34.

Additionally, FIG. 33 shows how adjacent wall panels are joined together. In particular, each wall panel includes an attachment 3070 on one edge. The attachment 3070 is formed by a pair of extensions, namely, an inner extension 3072 and an outer extension 3074. The extensions 3072, 3074 are generally parallel to and extend laterally from the wall portion from which the extend, but are offset slightly towards an interior 3076 of the wall panels. The inner extension 3072 extends laterally from an edge of the interior wall segment 3021, but is stepped back away from the burn chamber 3040. Similarly, the outer extension 3074 extends laterally from an edge of the exterior wall segment 3023, but is stepped inwardly toward the interior 3076 and the burn chamber 3040. As a result, the inner and outer extensions 3072, 3074 are closer together than the interior and exterior wall segments 3021, 3023, thereby permitting the attachment 3070 of one wall panel to be received in the interior 3076 of an adjacent wall panel between its interior and exterior wall segments 3021, 3023 on an edge opposite its own attachment 3070.

Each of the wall panels 3010, 3020, 3012, and 3008 are provided with attachment holes 3080. The attachment holes 3080 are provided in the interior and exterior wall segments 3021, 3023 and in the inner and outer extensions 3072, 3074 so that the attachment holes 3080 align when the attachment 3070 is received in the interior 3076 of an adjacent wall panel. When the attachment holes 3080 are aligned, the wall panels may be joined together by fasteners 3009 received in the aligned attachment holes 3080. Similar to the spacer tubes 716 discussed above, spacer tubes 3078 may be placed between the attachment holes 3080 in the attachments 3070. The spacer tubes 3078 not only provide guidance to the fasteners 3009 during assembly, the spacer tubes 3078 also space apart the inner and outer extensions 3072, 3074 so that tightening of the fasteners 3009 does not collapse the attachments 3070, thereby providing additional structural rigidity to the fire pit insert 3000.

Figure 34:
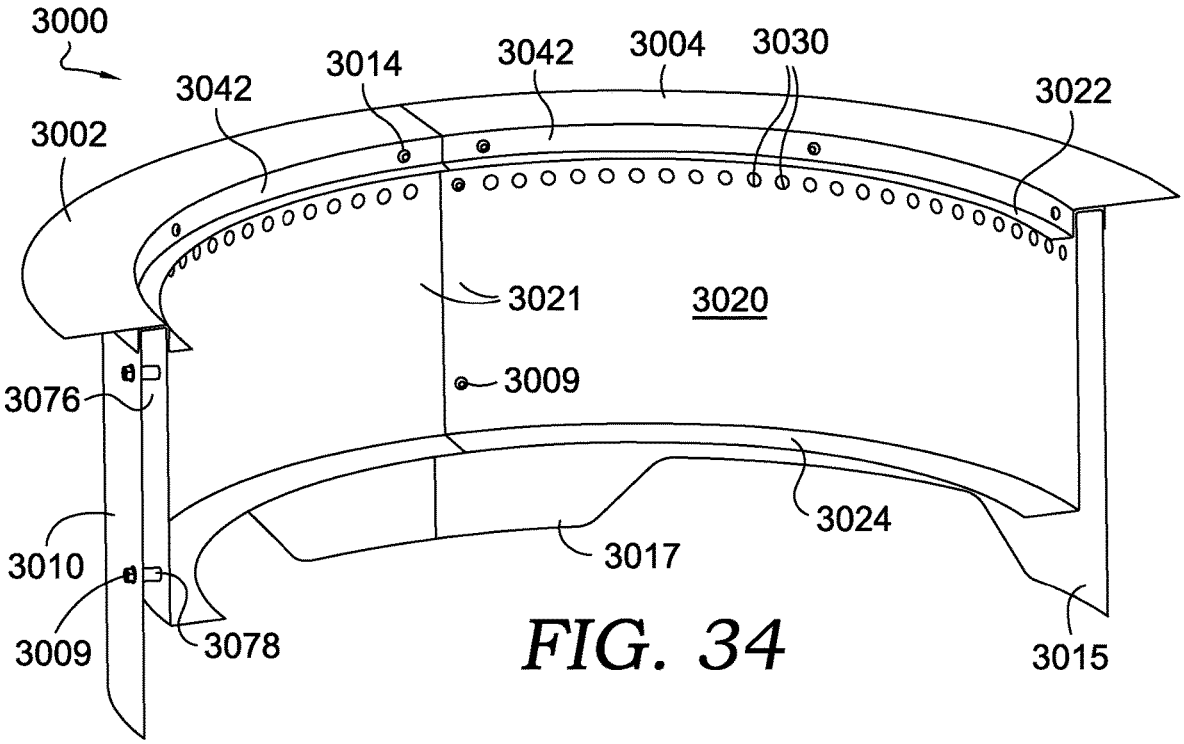
FIG. 34 is a top perspective view in cross-section of the fire pit insert of FIG. 29.

FIG. 34 illustrates a cross-section view of the round fire pit insert 3000. The interior wall segments 3021 of wall panels 3010 and 3020 can be seen, along with air openings 3030 and the flange 3024 upon which an ash catch would rest. The open space 3076 between the interior wall segment 3021 and the exterior wall segment 3023 can also be seen. The open space 3076 allows air flow through the fire pit insert 3000. The securement of the rim portions 3002 and 3004 to the interior wall segments 3021 by the securement points 3014 can also be seen. While the exterior wall segment 3023, the interior wall segment 3021, and the flange 3024 are all integrally formed in the illustrated embodiment (e.g., from a single sheet of metal that has been folded and bent into the illustrated shape), it is within the scope of the present invention for the exterior wall segment 3023 and the interior segment 3021 to be two separate pieces that are bolted together during the assembly process by the fasteners 3009 and securement points 3014. In the illustrated embodiment, the securement points 3014 are holes in the rim portions that align with holes in the wall panels through which a bolt passes to secure the rim portions to the wall panels. A tube 3078 may be placed in the wall panels between the holes in the wall panel at the securement point 3014 to guide the bolt there though.

Figure 35:
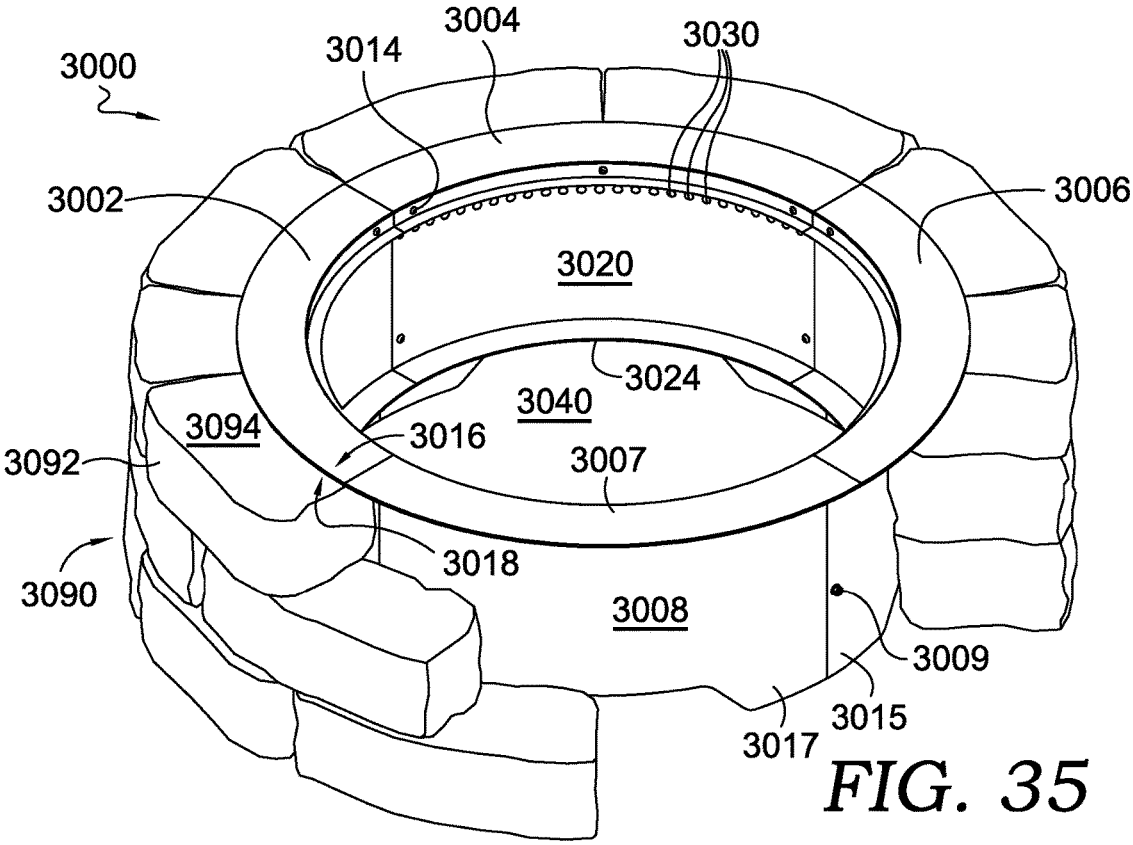
FIG. 35 depicts the fire pit insert of FIG. 29 inserted into a tumbled paver enclosure, with several of the pavers omitted for clarity.

FIG. 35 illustrates the round fire pit insert 3000 placed within a surrounding enclosure 3090. In the illustrated embodiment the enclosure is a plurality of tumbled stone pavers 3092 (several of which have been omitted to show an exterior of the fire pit insert 3000). As can be seen, the wall panels, such as panel 3008, can be used as a form around which the enclosure 3090 may be built. The wall panels may rest directly on a ground surface via the legs 3015 and 3017 or they may be supported above a ground surface inside the enclosure 3090 by the rim portions 3002, 3004, 3006, and 3007 resting on a top surface 3094 of the enclosure 3090. For example, the bottom surface 3018 of the rim portion 3002 may rest upon a top surface 3094 of the pavers 3092. The top surface 3016 of the rim portion 3002 is exposed. The open burn chamber 3040 can be seen along with the flange 3024 upon which the ash catch can rest (not shown). Air openings 3030 are depicted as well and provide for flow of the air for the smoke-free fire pit insert 3000.

Additionally, the enclosure 3090 is generally constructed to permit air to flow from outside the enclosure 3090 to the bottom of the fire pit insert 3000 and up into the burn chamber 3040. This can be accomplished by providing holes or openings in the enclosure 3090 (e.g., between adjacent stones or by omitting stones). If the enclosure is made of bricks, like enclosure 1004, the bricks may be spaced apart, so air gaps are provide there between, or bricks may be periodically omitted. While the air openings through the enclosure are generally near the base (which has the added benefit of letting any rain that enters the enclosure exit there through as well), they don't have to be, as combustion air can be drawn downward along the exterior of the fire pit insert and underneath the fire pit insert up into the burn chamber during use. Similarly, air openings through the enclosure can be omitted altogether by elevating the rim of the fire pit insert 3000 above the top surface 3094 of the enclosure 3090, thereby providing a gap (not shown) between the top surface 3094 of the enclosure 3090 and the bottom surface of the rim. Air will then travel underneath the rim, down the exterior of the fire pit insert (i.e., between it and an inner surface of the enclosure), through the recess 3019, and up into the bottom of the burn chamber 3040 during use.

Figure 36:
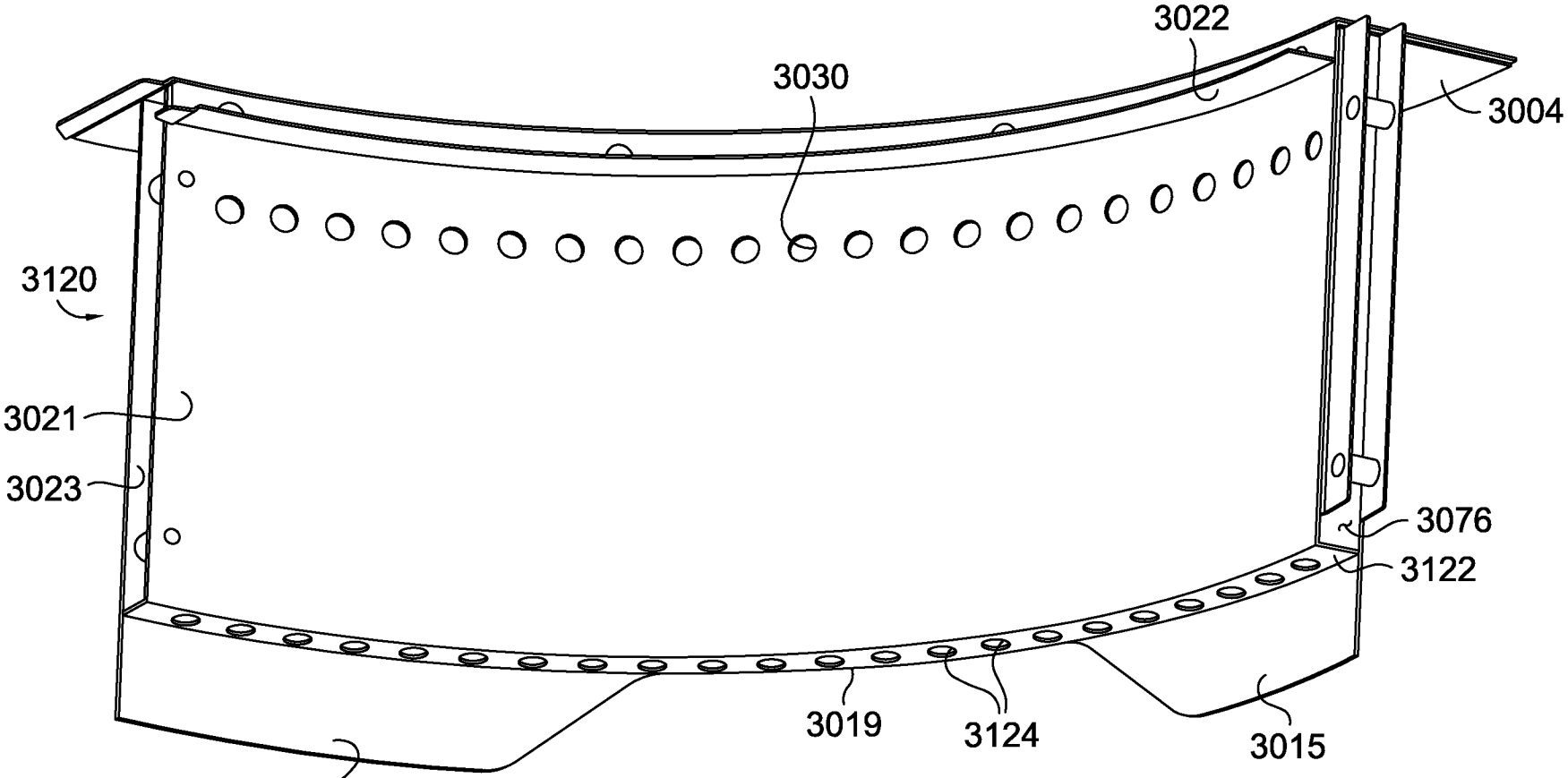
FIG. 36 is a perspective view of an alternate embodiment of a wall panel of a fire pit insert.

FIG. 36 illustrates a perspective view of an alternate embodiment of a wall panel 3120 of a fire pit insert 3000. The wall panels 3008, 3010, 3012, and 3020 of the embodiment illustrated in FIGS. 29-35 include the inwardly extending flange 3024 at the lower end of the inner wall. The primary purpose of the flange 3024 is to provide a support on which a grate and/or an ash catch may be placed to hold the combustible material up off of the ground to allow for greater air flow under the combustible material during use. However, in some instances, it may be desirable for the fire pit insert to be used without a grate and the combustible material (e.g., firewood) be placed directly on the ground inside the fire pit insert (or on a separate, free-standing grate). In those instances, the flange 3024 is unnecessary.

In this embodiment of the wall panel 3120, the inwardly depending flange 3024 is replaced with an outwardly depending flange 3122. The outwardly depending flange 3122 extends from a lower edge of the interior wall segment 3021 towards the exterior wall segment 3023. The outwardly depending flange 3122 provides structural rigidity to the interior wall segment 3021 and spaces a lower portion of the interior wall segment 3021 away from the exterior wall segment 3023. The outwardly depending flange 3122 is provided with a plurality of air holes 3124 to permit air to flow up through the open space 3076 between the interior wall segment 3021 and the exterior wall segment 3023 an out the air openings 3030 into the burn chamber 3040. The concepts of this alternate embodiment of a wall panel may be readily applied to the assemblable fire pit 110 and the assemblable fire pit insert 1010.

Embodiments of the invention are directed to a fire pit system configured to be assembled by an end user. The system includes a plurality of wall panels, an ash catch, and a grate. The plurality of wall panels are configured to be secured by the end user to form a burn chamber. Each of the plurality of wall panels has an interior wall segment spaced apart from an exterior wall segment. Each interior wall segment includes at least one opening in an upper end to allow airflow into the burn chamber. The ash catch is removably positionable and configured to be disposed within the burn chamber by the end user. The grate is positionable above the ash catch by the end user.

The opening is configured to allow airflow from a lower end into the burn chamber. Each wall panel of the plurality of wall panels may include a gusset disposed between the interior wall segment and the exterior wall segment configured to allow for vertical airflow through the wall panel. The fire pit system may also include a tube disposed between the interior wall segment and the exterior wall segment configured to receive a bolt there through. The bolt at least partially secures the one wall panel to another wall panel. Each wall panel of the plurality of wall panels may be formed from a first sheet and a second sheet, with the first sheet forming the outer wall segment of the wall panel with an upper portion bent back and a lower portion bent out to form a base, and the second sheet forming the inner wall segment with a lower portion bent inwardly to form a flange. The ash catch includes a peripheral flange, and wherein the peripheral flange of the ash catch rests on the flange of the wall panels when the fire pit is assembled. The grate is configured to rest on the peripheral flange of the ash catch, and includes a recess to allow a handle of the ash catch to pass around the grate.

In embodiments, a method of assembling a fire pit may include securing a plurality of wall panels to form a burn chamber, wherein each of the plurality of wall panels has an interior wall segment spaced apart from an exterior wall segment, positioning an ash catch on a flange of the interior wall segment within the burn chamber; and positioning a grate above the ash catch, wherein a first wall panel of the plurality of wall panels is configured to be connected together by aligning a hole in one flange with the hole on the opposite edge of an adjacent panel. The method may further include orienting the inner wall toward the burn chamber such that an opening at an upper end of the inner wall is configured to allow airflow from a lower end into the burn chamber. The method may further include orienting the inner wall such that a gusset disposed between the interior wall segment and the exterior wall segment is oriented vertically, so as to allow for vertical airflow through the wall panel.

The above-discussed step of securing may include inserting a bolt into a tube disposed between the interior wall segment and the exterior wall segment, wherein the bolt at least partially secures the first wall panel to the second wall panel.

The method may further include placing the base onto an underling surface, wherein each wall panel of the plurality of wall panels is formed from a first sheet and a second sheet, the first sheet forming the outer wall segment of the wall panel with an upper portion bent back and a lower portion bent out to form the base. The above-discussed step of positioning the ash catch may include placing a peripheral flange of the ash catch onto the flange of the wall panels when the fire pit is assembled.

Embodiments of the invention are directed to a method of burning fuel in a fire pit. The method may include placing an ash catch into the fire pit and placing a grate atop the ash catch. The method may include placing a fuel into a burn chamber of the fire pit atop the grate and the ash catch. The method may further include applying a fire starter to the fuel so as to create a fire in the burn chamber. Following usage, the method may include removing the ash catch from the burn chamber and disposing of the ashes within the ash catch. The method may further include removing the ash catch from the burn chamber by lifting it up through the burn chamber and out a top of the burn chamber. The method may further include removing the grate along with the unburnt fuel if any.

Embodiments of the invention are directed to a fire pit insert comprising a plurality of wall panels and a plurality of rim portions. The plurality of wall panels each comprise a top end and a bottom end and are configured to be coupled together to form a burn chamber. Each of the plurality of wall panels has an interior wall segment that is spaced apart from an exterior wall segment. The interior wall segment includes one or more airflow openings near the top end. The plurality of wall panels include a portion designed to be coupled with the adjacent panel. Each of the rim portions has a top surface and a bottom surface, wherein a rim portion is removably coupled to a first of the plurality of wall panels. The fire pit insert may be inserted into a surrounding structure and when inserted, the bottom surface of the rim portions rests upon a top surface of the surrounding structure.

Additionally, in embodiments a round fire pit insert described herein may also comprise an ash catch configured to be located at least partially below the burn chamber. The fire pit insert defines an opening into the burn chamber near a top end of the inner wall segment. Additionally, the found fire pit insert includes a gusset disposed between the interior wall segment and the exterior wall segment configured to allow for vertical airflow through the wall panel.

In aspects, a first tube disposed between the interior wall segment and the exterior wall segment is configured to receive a bolt there through. The bold at least partially secures the first wall panel to the second wall panel. The fire pit insert also includes a second tube disposed between the interior wall segment and the exterior wall segment and configured to receive a bolt there through, wherein the bolt at least partially secures the first rim portion to the wall panel.

In one embodiment each wall panel of the plurality of wall panels is formed from a first sheet and a second sheet. The first sheet forming the exterior wall segment of the wall panel having a top portion and a bottom portion, the bottom portion having a first leg portion, a second leg portion, and a recessed portion located between the first and second legs, wherein the bottom portion is configured to sit directly upon a ground surface. The second sheet forms the inner wall segment with a lower portion bent inwardly to form a flange, wherein the flange is configured to receive a portion of an ash catch and/or grate thereon. In another embodiment, each wall panel of the plurality of wall panels is formed from a single sheet and interior and exterior wall segments are unitary and joined by an upper portion.

In other embodiments, a fire pit insert system configured to be assembled by an end user is disclosed. The fire pit insert system includes a plurality of rim portions that are configured to rest on a top surface of a structure that surrounds the fire pit insert. The fire pit insert also includes a plurality of wall panels that are configured to be secured together by the end user to form a burn chamber. Each of the plurality of wall panels has an interior wall segment spaced apart from an exterior wall segment. The first wall panel of the plurality of wall panels is removably coupled to a first rim portion of the plurality of rim portions. The space between the interior wall segment and the exterior wall segment is configured to allow airflow from a lower end of the wall panel into the burn chamber. Each wall panel also includes a gusset disposed between the interior wall segment and the exterior wall segment and is configured to space the wall segments apart and allow for vertical airflow through the wall panel. Additionally, the fire pit insert system includes a tube disposed between the interior wall segment and the exterior wall segment and configured to receive a bolt there through. The bolt at least partially secures a first wall panel of the plurality of wall panels to a second wall panel of the plurality of wall panels. Each of the interior wall segments comprise a plurality of airflow openings.

In other embodiments a method of assembling a fire pit insert is disclosed. The method comprises securing a plurality of wall panels together to form a burn chamber, wherein each of the plurality of wall panels has an interior wall segment spaced apart from an exterior wall segment. Each of the plurality of wall panels have a top portion and a bottom portion, the bottom portion includes two legs that extend further vertically than a middle recessed portion. An ash catch is removably positioned on a flange of the interior wall segment within the burn chamber and a grate is positioned above the ash catch. A plurality of rim portions are removably secured to the plurality of wall panels. A first wall panel of the plurality of wall panels is configured to be connected to an adjacent wall panel by aligning a hole in one flange with a hole on the opposite edge of the adjacent panel.

The method may further include orienting the interior wall segment toward the burn chamber such that an opening at an upper end of the inner wall is configured to allow airflow from a lower end through the opening and into the burn chamber. Additionally, the method may include orienting the interior wall segment such that a gusset disposed between the interior wall segment and the exterior wall segment is oriented vertically, so as to allow for vertical airflow through the wall panel. The step of securing each wall panel of the plurality of wall panels may also include inserting a bolt into a tube disposed between the interior wall segment and the exterior wall segment, wherein the bolt at least partially secures the first wall panel to the second wall panel.

From the foregoing it will be seen that this invention is one well adapted to attain all ends and objects hereinabove set forth together with the other advantages which are obvious and which are inherent to the method, system and apparatus. It will be understood that certain features and subcombinations are of utility and may be employed without reference to other features and subcombinations. For example, while the illustrated embodiment discloses a desirable embodiment of a ready-to-assemble ("RTA") fire pit, several disclosed features may be omitted and a still desirable RTA fire pit would be provided and within the scope of the present invention. For example, in the illustrated embodiment the RTA fire pit includes a removable ash catch that is supported by the side walls and a grate that is supported on the ash catch. One or both of the ash catch and the grate could be omitted and a still desirable RTA fire pit could be provided. The ash catch could be omitted (letting the ash simply fall to the ground) or designed to support itself on the ground when positioned freestanding inside the space defined by the assembled walls. Similarly, the grate could be omitted (with the fuel placed in the ash catch or on the ground) or designed to be supported directly by the side walls spaced apart from and above the ash catch.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

What is claimed is:

1. A fire pit insert comprising:

a plurality of wall panels having a top end and a bottom end and configured to be coupled together to form a burn chamber, wherein each of the plurality of wall panels has an interior wall segment spaced apart from an exterior wall segment and an attachment with holes therein, wherein the interior and exterior wall segments have holes therein, wherein at least one of the interior wall segments includes an airflow opening adjacent a top end, wherein each of the plurality of wall panels are configured to be removably coupled with an adjacent panel by receiving the attachment of one wall panel in between the interior and exterior wall segments of the adjacent wall panel, aligning the holes in the attachment with the holes in the interior and exterior wall segments of the adjacent wall panel, and receiving a bolt in the aligned holes; and a plurality of rim portions, wherein each of the rim portions has a top surface and a bottom surface, wherein a first rim portion is removably coupled to a first of the plurality of wall panels.

2. The fire pit insert of claim 1, wherein when the fire pit insert is inserted into a surrounding structure, the bottom surface of the rim portions rests upon a top surface of the surrounding structure.

3. The fire pit insert of claim 1, wherein each interior wall segment of the plurality of wall panels comprises a plurality of airflow openings.

4. The fire pit insert of claim 1, further comprising at least one of:

an ash catch configured to be disposed at least partially below the burn chamber; and a grate configured to be disposed at least partially below the burn chamber.

5. The fire pit insert of claim 1, wherein the airflow opening is configured to allow airflow from a lower end into the burn chamber and wherein the airflow opening is disposed near a top end of the interior wall segment.

6. The fire pit insert of claim 1, wherein each wall panel of the plurality of wall panels further comprises:

a gusset disposed between the interior wall segment and the exterior wall segment configured to space the interior and exterior wall segments apart and allow for vertical airflow through the wall panel.

7. The fire pit insert of claim 6, further comprising:

a first tube disposed between the interior wall segment and the exterior wall segment configured to receive a bolt there through, wherein the bolt at least partially secures the first wall panel of the plurality of wall panels to a second wall panel of the plurality of wall panels.

8. The fire pit insert of claim 7, further comprising:

a second tube disposed between the interior wall segment and the exterior wall segment and configured to receive a second bolt there through, wherein the second bolt at least partially secures the first rim portion to the first wall panel.

9. The fire pit insert of claim 4, wherein each wall panel of the plurality of wall panels is formed from a first sheet and a second sheet, the first sheet forming the exterior wall segment of the wall panel having a top portion and a bottom portion with a first leg, a second leg, and a recessed portion located between the first and second legs, wherein the bottom portion is configured to sit directly upon a ground surface, and the second sheet forming the inner wall segment with a lower portion bent inwardly to form a flange, wherein the flange is configured to receive a portion of at least one of the ash catch and grate thereon.

10. The fire pit insert of claim 1, wherein the bottom end of each non-linear wall panel comprises two legs extending vertically further than a middle recessed portion when the fire pit insert is assembled.

11. The fire pit insert of claim 8, wherein each of the wall panels of the plurality of wall panels have the same shape and size, wherein each of the wall panels of the plurality of wall panels are arcuate in shape, and wherein the plurality of wall panels, when coupled together, form a round fire pit insert.

12. A fire pit insert system configured to be assembled by an end user, the system comprising:

a plurality of wall panels configured to be secured together by the end user to form a burn chamber, wherein each of the plurality of wall panels has an interior wall segment spaced apart from an exterior wall segment defining a space there between, wherein each of the plurality of wall panels has an attachment with holes therein, wherein the interior and exterior wall segments have holes therein, wherein one of the plurality of wall panels is secured to another of the plurality of wall panels by receiving the attachment of the one of the plurality of wall panels in the space between the interior and exterior wall segments of the another of the plurality of wall panels, aligning the holes in the attachment of the one of the plurality of wall panels with the holes in the interior and exterior wall segments of the another of the plurality of wall panel, and receiving one or more bolts in the aligned holes; and a plurality of rim portions configured to be removably coupled to the plurality of wall panels, wherein the rim portions, when the wall panels are secured together and the rim portions are coupled with the wall panels, rest on a top surface of a structure surrounding the fire pit insert system when the fire pit insert system is placed therein.

13. The fire pit insert system of claim 12, wherein the space between the interior wall segment and the exterior wall segment is configured to allow airflow from a lower end of the wall panels into the burn chamber.

14. The fire pit insert system of claim 12, wherein each wall panel of the plurality of wall panels further comprise:

a gusset disposed between the interior wall segment and the exterior wall segment configured to space the interior and exterior wall segments apart and allow for vertical airflow through the wall panel.

15. The fire pit insert system of claim 12, further comprising:

a bolt; and a tube disposed between the interior wall segment and the exterior wall segment and configured to receive the bolt there through, wherein the bolt at least partially secures a first wall panel of the plurality of wall panels to a second wall panel of the plurality of wall panels.

16. The fire pit insert system of claim 12, wherein each of the interior wall segments include a plurality of airflow openings.

17. A method of assembling a fire pit insert comprising:

securing a plurality of wall panels together to form a burn chamber, wherein each of the plurality of wall panels has an interior wall segment spaced apart from an exterior wall segment and wherein each of the plurality of wall panels comprise a top portion and a bottom portion, the bottom portion comprising two legs that extend further vertically than a middle recessed portion;

positioning an ash catch on a flange of the interior wall segment within the burn chamber;

positioning a grate above the ash catch;

securing one or more rim portions to the top portion of one or more of the plurality of wall panels; and connecting a first wall panel of the plurality of wall panels to a second wall panel of the plurality of wall panels by receiving an attachment of the first wall panel in between the interior and exterior wall segments of the second wall panel, aligning holes in the attachment with holes in the interior and exterior wall segments of the second wall panel, and receiving a bolt in the aligned holes.

18. The method of claim 17, further comprising:

orienting the interior wall segments toward the burn chamber such that an opening at an upper end of the interior wall segments is configured to allow airflow from a lower end through the opening and into the burn chamber and orienting the interior wall segments such that a gusset disposed between the interior wall segments and the exterior wall segments is oriented vertically, so as to allow for vertical airflow through the plurality of wall panels.

19. The method of claim 17, wherein the step of securing each wall panel of the plurality of wall panels includes:

inserting a bolt into a tube disposed between an inner extension and an outer extension of an attachment of a first one of the plurality of wall panels, wherein the bolt at least partially secures the first one of the plurality of wall panels to a second one of the plurality of wall panels.

* * * * *